United States Patent [19]

Dickinson et al.

[11] Patent Number: 4,660,833

[45] Date of Patent: Apr. 28, 1987

[54] REEL MONITORING AND DIAGNOSTIC DEVICE FOR AN AMUSEMENT MACHINE

[75] Inventors: Peter D. Dickinson; William Bertram, both of Reno, Nev.

[73] Assignee: IGT, Reno, Nev.

[21] Appl. No.: 726,547

[22] Filed: Apr. 24, 1985

Related U.S. Application Data

[63] Continuation-in-part of Ser. No. 688,295, Jan. 2, 1985.

[51] Int. Cl.[4] ..... A63F 5/04

[52] U.S. Cl. ..... 273/143 R; 273/138 A

[58] Field of Search ..... 273/143 R, 138 A; 74/527

[56] References Cited

U.S. PATENT DOCUMENTS

| | | | |
|---|---|---|---|
| 4,037,845 | 1/1976 | Hooker . | |
| 4,099,722 | 7/1978 | Rodesch et al. | 273/143 R |
| 4,238,127 | 1/1977 | Lucero et al. . | |
| 4,262,906 | 5/1979 | Heywood . | |
| 4,421,310 | 9/1979 | Williams . | |
| 4,440,036 | 9/1981 | Hooker et al. . | |

*Primary Examiner*—Leo P. Picard

*Attorney, Agent, or Firm*—Townsend and Townsend

[57] ABSTRACT

A self-diagnostic apparatus is disclosed which has a transducer, such as a solenoid, for performing a mechanical movement in response to an electrical signal of at least a "first energy," such as a constant DC voltage applied over a predetermined time period. A control device, such as a microprocessor-based control circuit, is used to provide an electrical signal of greater energy than the "first energy" in response to a predetermined condition during operation of the apparatus. Such a predetermined condition may be the arrival of one of a slot machine's reels at a rotational position in which it is intended to be stopped. A diagnostic test initiating device, such as a switch, is used for signalling the start of a test of the transducer. The control device further includes a testing device which is responsive to the diagnositc test initiating device for providing an electrical signal of the first energy to the transducer. A verification device, such as an optical sensor and associated tilt detection circuitry, detects whether the transducer has performed its mechanical movement in response to the first energy electrical signal. An indicator, such as a visual display, responds to the verification device for indicating whether or not the mechanical movement has been detected in response to the diagnostic test initiating device.

14 Claims, 26 Drawing Figures

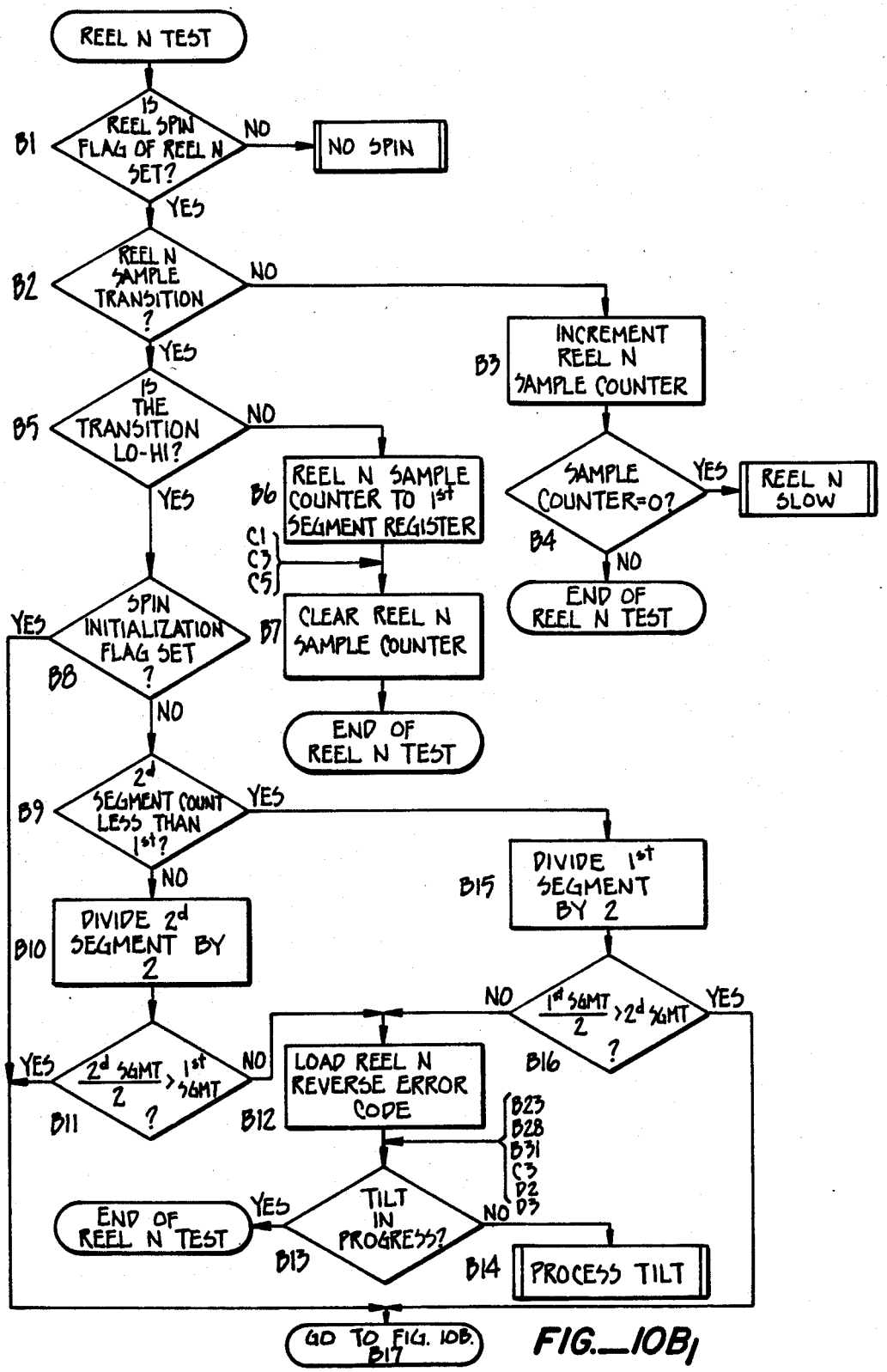
FIG._10B1

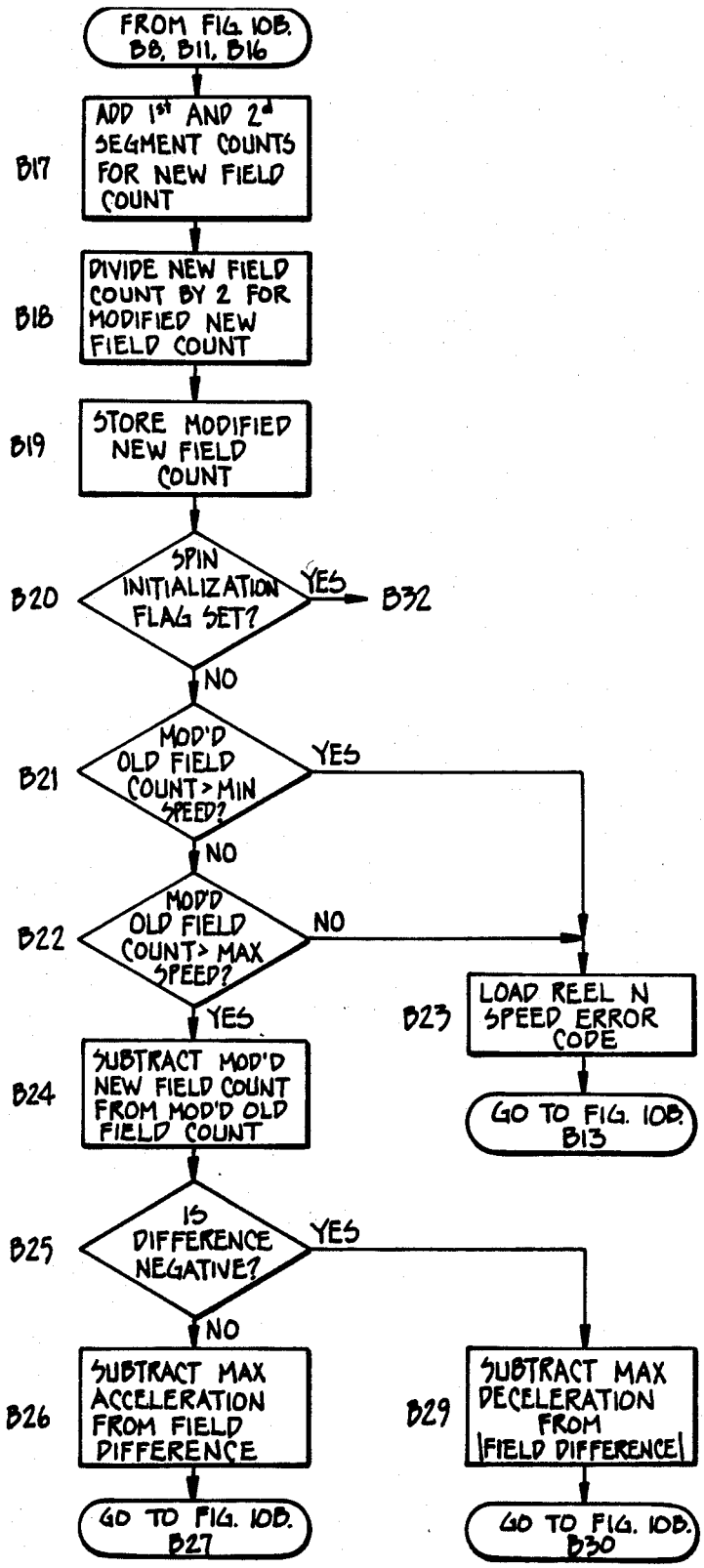
FIG._10B2

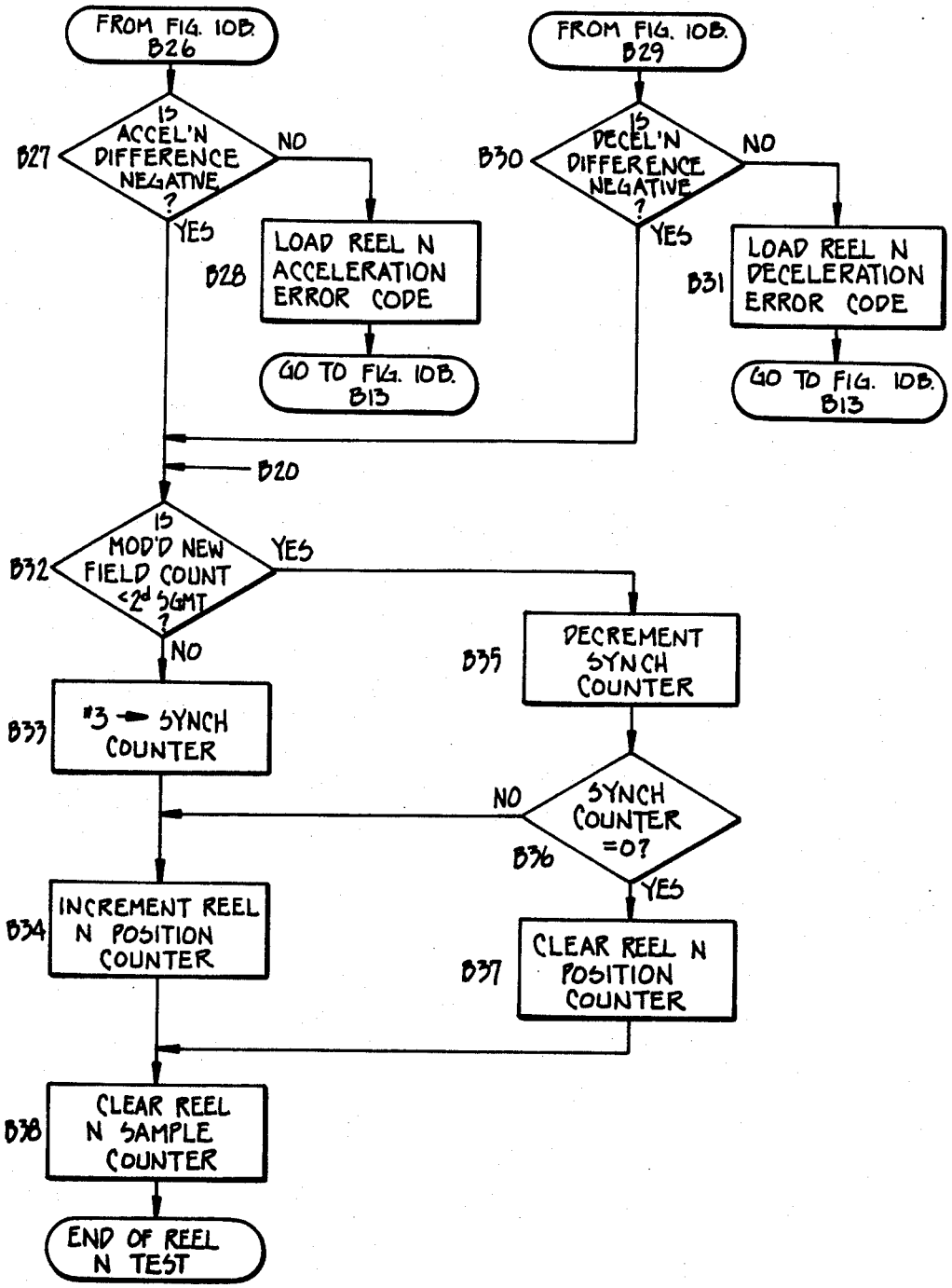
FIG._10B3

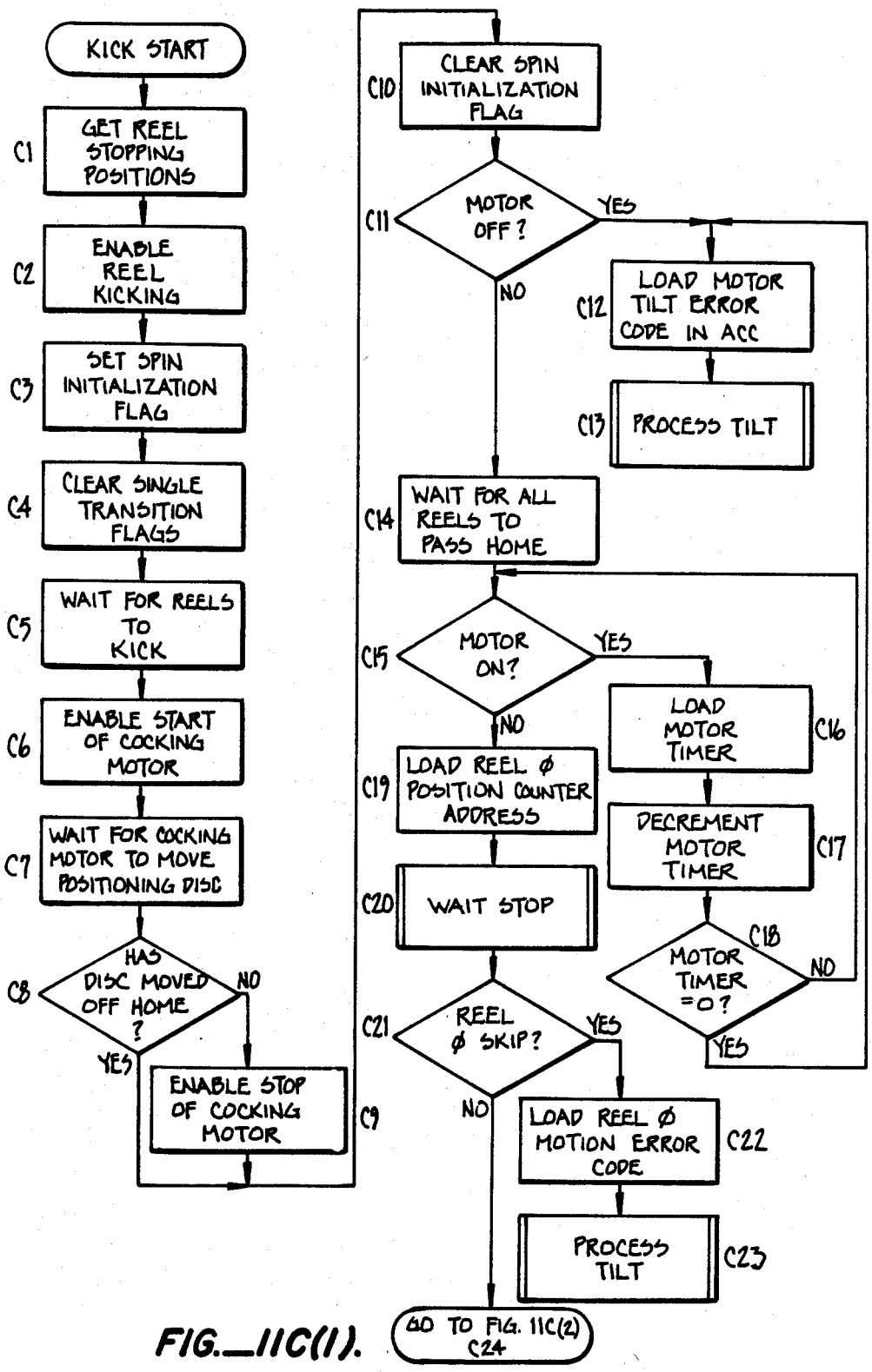
FIG._11C(1).

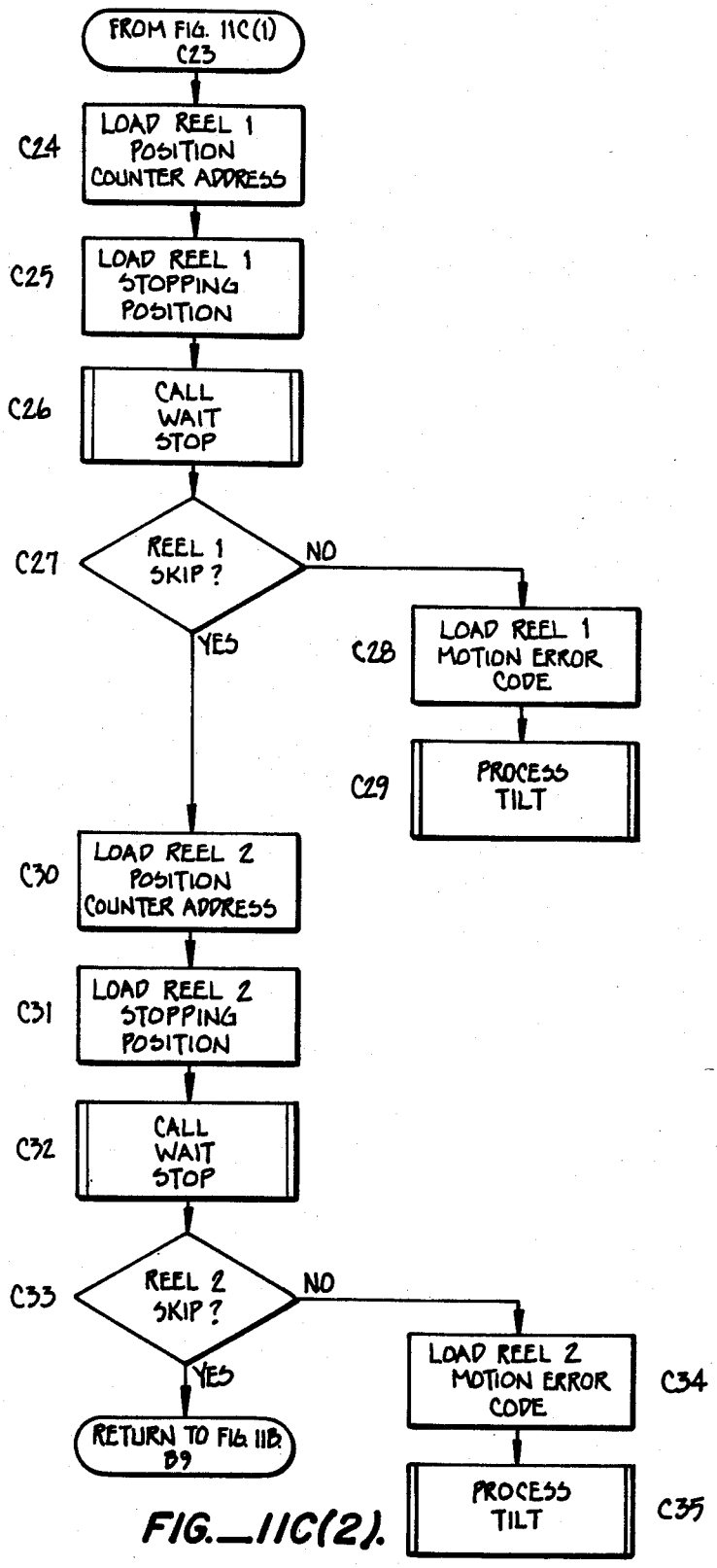
FIG._11C(2).

REEL MONITORING AND DIAGNOSTIC DEVICE FOR AN AMUSEMENT MACHINE

This is a continuation-in-part application of U.S. patent application Ser. No. 688,295, filed Jan. 2, 1985.

This document is submitted with a microfiche appendix, pursuant to 37 C.F.R. 1.96, consisting of 1 fiche having a total of 45 frames.

BACKGROUND OF THE INVENTION

The present invention relates generally to apparatus having mechanisms which are subject to wear and/or sluggish response from factors such as age, friction, or accumulations of residue in the moving parts, and to systems for diagnosing the existence of such wear and/or sluggish response so that appropriate servicing and maintenance may be directed to the affected parts. The invention particularly relates to the application of such diagnostic systems to amusement machines having rotating reel assemblies, such as coin operated slot machines of the type found in Monte Carlo, Reno and other internationally known gaming resorts.

SUMMARY OF THE INVENTION

In accordance with a preferred, but nonetheless illustrative embodiment of the invention, a slot machine is disclosed having a diagnostic system for use by a service technician in determining whether or not certain mechanisms associated with spinning and stopping of the slot machine's reels are in need of maintenance or repair. It will be appreciated that such diagnostic systems may be used in a wide variety of applications outside the field of slot machines and other amusement machines, and that the present invention contemplates all such uses which fall within the scope of the appended claims.

In one aspect of the present invention, a self-diagnostic apparatus is provided which has a transducer, such as a solenoid, for performing a mechanical movement in response to an electrical signal of at least a "first energy," such as a constant DC voltage applied over a predetermined time period. A control device, such as a microprocessor-based control circuit, is used to provide an electrical signal of greater energy than the "first energy" in response to a predetermined condition during operation of the apparatus. Such a predetermined condition may be the arrival of one of a slot machine's reels at a rotational position in which it is intended to be stopped. A diagnostic test initiating device, such as a switch, is used for signalling the start of a test of the transducer. The control device further includes a testing device which is responsive to the diagnostic test initiating device for providing an electrical signal of the first energy to the transducer. A verification device, such as an optical sensor and associated tilt detection circuitry, detects whether the transducer has performed its mechanical movement in response to the first energy electrical signal. An indicator, such as a visual display, responds to the verification device for indicating whether or not the mechanical movement has been detected in response to the diagnostic test initiating device.

In another aspect of the invention, an apparatus is provided for controlling the engagement of two relatively moving members. First and second members, such as a sprocket and pawl arm, are configured for mutual engagement at one of a plurality of discrete contact positions, and adapted to be driven into and out of engagement with each other. A mechanism is provided for driving at least one of the members into engagment with the other member in response to an electrical signal. For instance, the pawl arm may be pivotally mounted and spring loaded, with a solenoid driven trip lever restraining the pawl arm against the spring's tension. The movement of the first and second members relative to each other is such that the driving mechanism must engage the members within a range of operating times after receipt of the electrical signal, in order for the members to engage at an intended one of the contact positions (e.g., at an intended gap between two of the sprocket's teeth). A control device, such as a microprocessor-based control circuit, is provided to control the engagement of the two members at the intended contact position, including a device for issuing the electrical signal to the driving mechanism based on a predetermined design response time of the driving mechanism which is within the above-mentioned range of response times. A diagnostic test initiating device, such as a switch, is used to command a test of the driving mechanism. The control device further includes a device responsive to the diagnostic test initiating device for timing the issuance of the electrical signal to the driving mechanism based on a response time within the above-mentioned range of response times, and offset from the design response time in the direction of anticipated possible degradation of the driving mechanism.

BRIEF DESCRIPTION OF THE DRAWINGS

FIGS. 10A to 10E are flow charts illustrating the processing steps performed by the microprocessor during an interrupt routine.

FIGS. 11A to 11D are flow charts illustrating the processing steps performed by the microprocessor during a diagnostic test routine.

DESCRIPTION OF THE PREFERRED EMBODIMENT

Figure 1:
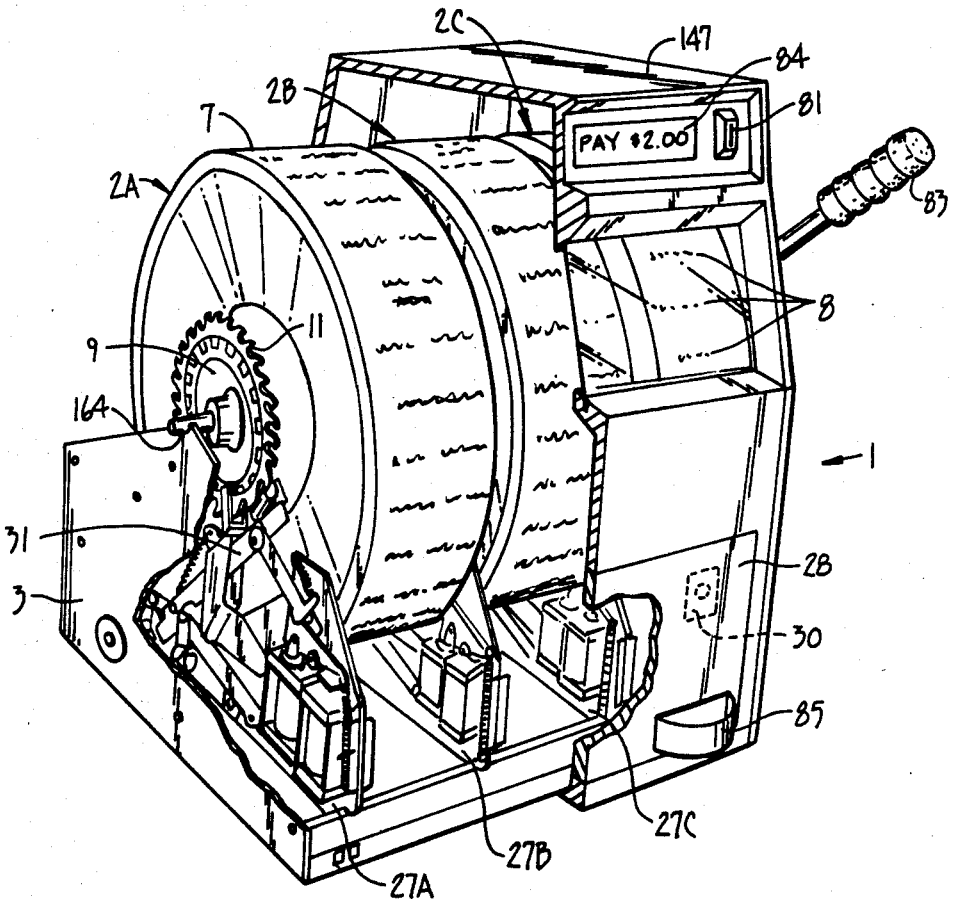
FIG. 1 is a perspective view of a slot machine according to the present invention, having portions cut away to expose the reels and rotation governing modules.

A preferred embodiment of the present invention will now be described with reference to a coin-operated slot machine 1, as seen in FIG. 1, having three coaxially mounted reels 2A, 2B and 2C which are simultaneously spun and, after a period of free wheeling rotation, are independently stopped at a set of randomly determined stopping positions. For ease of reference, the mechanical operation of this embodiment will be briefly described below. A more thorough treatment of the mechanical structure and operation of this device may be found in U.S. patent application Ser. No. 664,185, filed Oct. 24, 1984 (Amusement Machine), which is incorporated herein by reference.

Figure 2:
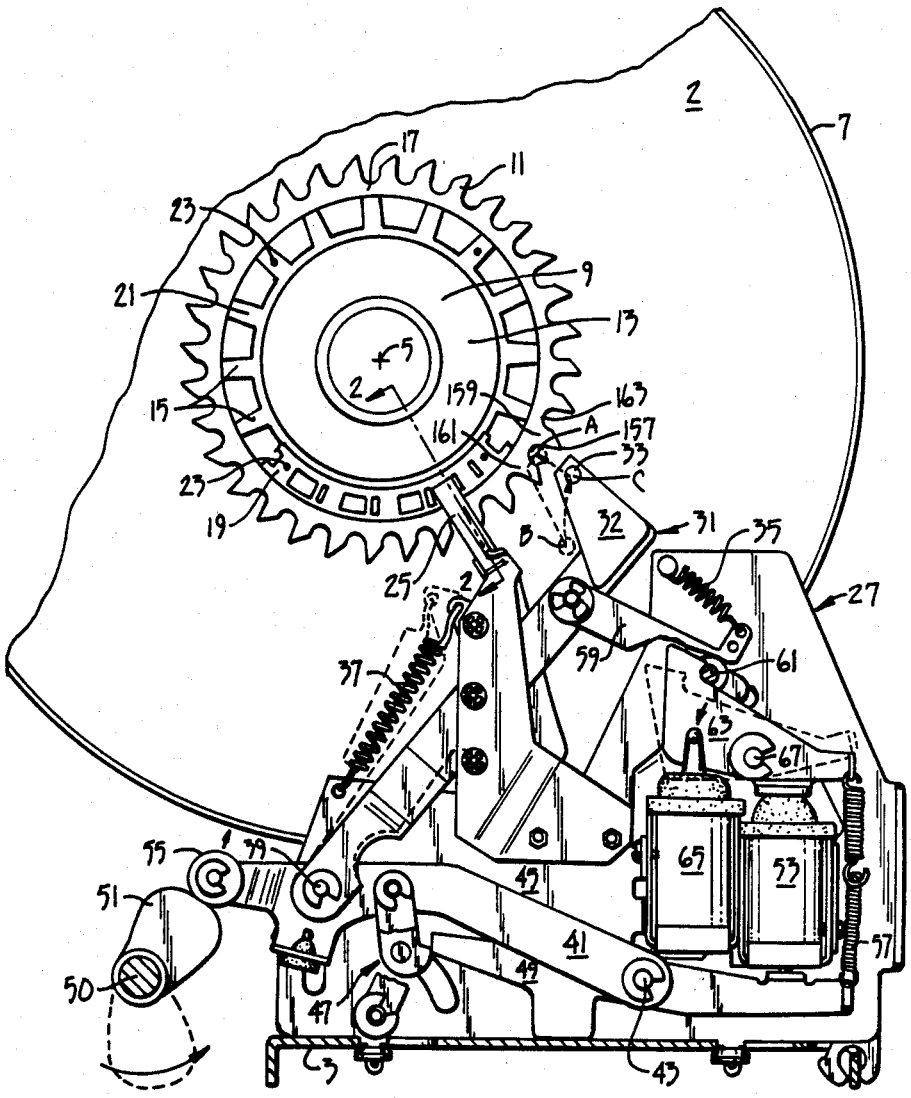
FIG. 2A is an elevational view of a reel and its corresponding sprocket and rotation governing module illustrating the three phases of module operation.
Figure 3:
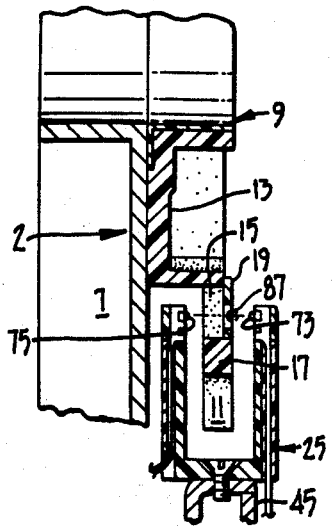
FIG. 3 is a sectional view along line 3—3 of FIG. 2.

FIGS. 2 and 3 illustrate one of the three reels of the preferred embodiment, and a corresponding rotation governing module which is used to start and stop the reel's rotation. Reel 2 measures 12¾" in diameter, and is mounted in a frame 3 for rotation about an axis 5. The reel 2 has a flange, or rim 7 at its outer periphery which bears various game playing indicia 8, such as cherries, oranges, gold bars and other readily identifiable symbols, at designated locations. In the embodiment described, thirty-two indicia 8 are equally spaced about the peripheral rim 7 of reel 2, corresponding to the thirty-two discrete stopping positions of the reel.

A sprocket 9, having thirty-two teeth 11 equally spaced about its outer periphery, is coaxially mounted for rotation with reel 2. The sprocket measures 5.25" in diameter to the tips of teeth 11, and 4.8" in diameter with respect to the gaps between the teeth. Sprocket 9 comprises a hub 13 having sixteen equally spaced spokes 15 extending radially outwardly to support a ring 17 of teeth 11 at the sprocket's outer periphery. A thin, stamped coding ring 19, having a pattern of slots which will be discussed in detail below, is seated against spokes 15 in a recessed region 21 radially inward of peripheral ring 17, and held in place by mounting pegs 23. A photoelectric sensor 25 straddles the peripheral ring 17 and coding ring 19, as seen in FIG. 3, and cooperates with coding ring 19 to monitor the rotation of reel 3 in a manner more fully described below.

Figure 7:
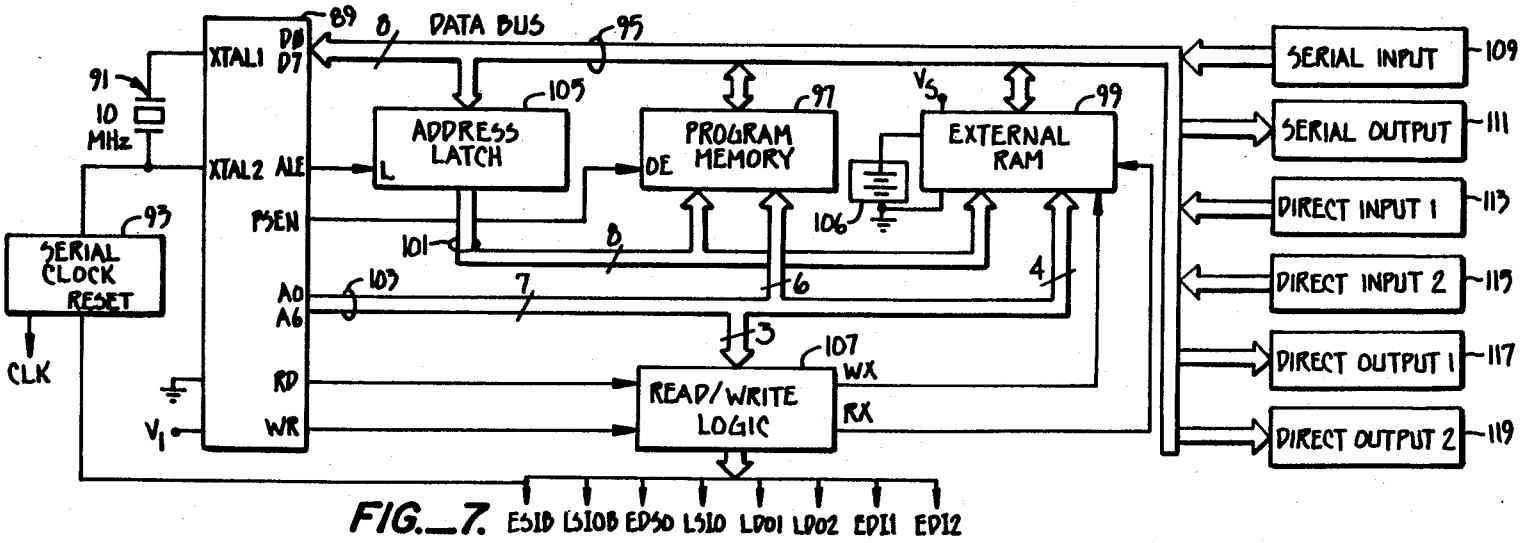
FIG. 7 is a schematic diagram of a microprocessor-based control circuit according to the present invention, for monitoring reel rotation and providing appropriate error detection signals.

A rotation governing module, indicated generally at 27, is fixed to frame 3 adjacent its corresponding reel 2, to alternately spin and stop the reel's rotation in response to electrical signals from a control circuit 29 (FIG. 7). A hinged door 28 provides access to the machine's interior, enabling rapid replacement of faulty modules 27 by a service technician. Door 28 also provides access to a pushbutton switch 30 which signals the start of a series of diagnostic tests, as discussed in more detail below. Module 27 comprises a rigid pawl arm 31 which moves through a three-phase movement in response to control circuit 29, so as to initiate a period of free-wheeling reel spin and then stop the reel at one of the stopping positions defined by teeth 11.

The upper end of pawl arm 31 supports resilient stop head 32 having a pin 33 which engages the teeth 11 of sprocket 9 when the reel is at rest, as seen at position A in dotted lines in FIG. 2. In this REEL SET position, pawl arm 31 experiences light tension from stop spring 35, which urges pin 33 in a generally radial direction against peripheral ring 17, and strong tension from start spring 37, which urges pawl arm 33 generally downwardly against pivot pin 39 on guide arm 41. Guide arm 41 is pivotally mounted on pin 43, which is fixed to base plate 45. It is held in the position shown in FIG. 2, against the pressure of start spring 37, by toggle link 47, which is locked in the extended position shown by trip lever 49. Cam 51 is positioned as seen in dotted lines in FIG. 2, enabling guide arm 41 to move downwardly during the first phase of pawl arm movement.

Figure 4A:
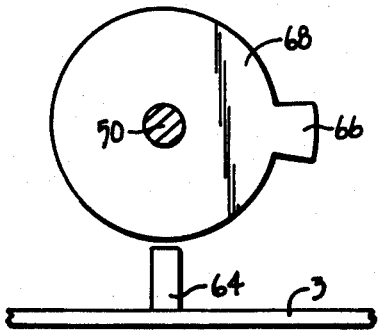
FIGS. 4A and 4B are elevational views illustrating a cocking motor for the rotation governing module of FIG. 2, and its associated position sensing apparatus.
Figure 4B:
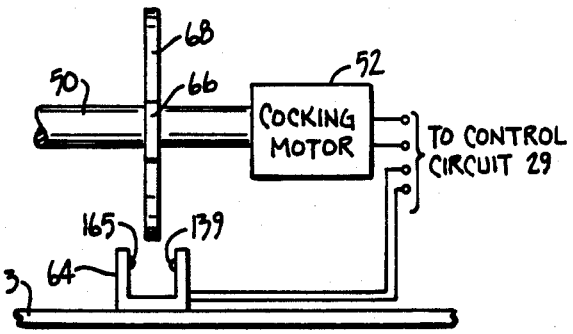

Rotation of reel 2 is initiated when control circuit 29 issues a START SPIN signal to starting solenoid 53, which pushes downwardly against first trip lever 49, rotating the trip lever in a clockwise direction about pin 43. As the left end of first trip lever 49 clears toggle link 47, the toggle link collapses under the pressure of start spring 37, causing guide arm 41 to rapidly pivot counterclockwise about pin 43, drawing pawl arm 31 downwardly and causing pin 33 to move from position A to position B along the dotted path shown in the drawing. This initiates a free-wheeling rotation of reel 2 at approximately one revolution per second. Camshaft 50 is then rotated by electric cocking motor 52 (FIG. 4), causing cam 51 to turn in a counterclockwise direction, engaging cam follower 55 and lifting guide arm 41 to the position seen in the drawing. The left end of first trip lever 49 then drops down, under tension of spring 57, to lock toggle link 47 in the position shown. This lifting action of cam 51 causes pawl arm 31 to move through a second phase of movement, from the above-described REEL SPIN position to the COCKED position illustrated in solid lines. During this movement, pin 33 travels along the dotted path of FIG. 2 from position B to position C, causing stop spring 35 and start spring 37 to be stretched in preparation for the following two phases of pawl arm movement. In its stretched state, stop spring 35 applies strong tension to a stop lever 59 which joins the upper end of pawl arm 31 to a pin 61 slidably mounted on base plate 45. A second trip lever 63 engages pin 61 during the second phase of pawl arm movement, restraining the leftward movement of stop lever 59 as pawl arm 31 is raised to the COCKED position, thus stretching spring 35 in preparation for the third phase of pawl arm movement. After camshaft 50 has completed one full revolution, an optical camfshaft sensor 64 (FIGS. 4A and 4B) detects the presence of finger 66 in camshaft positioning disc 68, and signals control circuit 29 to turn off cocking motor 52, as described more fully below.

In the third phase of movement, pawl arm 31 pivots about pin 39 from the COCKED position (solid lines) to the REEL SET position discussed above, carrying pin 33 along the dotted path of FIG. 2 from position C to position A. The third phase movement is initiated when control circuit 29 issues a STOP SPIN signal to stopping solenoid 65, which pulls second trip lever 63 in a counterclockwise direction about pin 67, to the position seen in dotted lines in FIG. 2. This releases pin 61, enabling stop lever 59 to push pawl arm 31 upwardly and to the left under pressure of stop spring 35, causing pin 33 to lodge between two adjoining teeth 11 of sprocket 9 and stop the rotation of reel 2 at one of the thirty-two stopping positions defined by the teeth.

The position and movement of each reel 2 are constantly monitored to assure that unauthorized personnel cannot interrupt the randomness of a reel spinning operation or change the stopping positions of the reels in between rounds of game play. Reel monitoring is performed by the interaction of sensor 25 and coding ring 19, in conjunction with control circuit 29.

Figure 5:
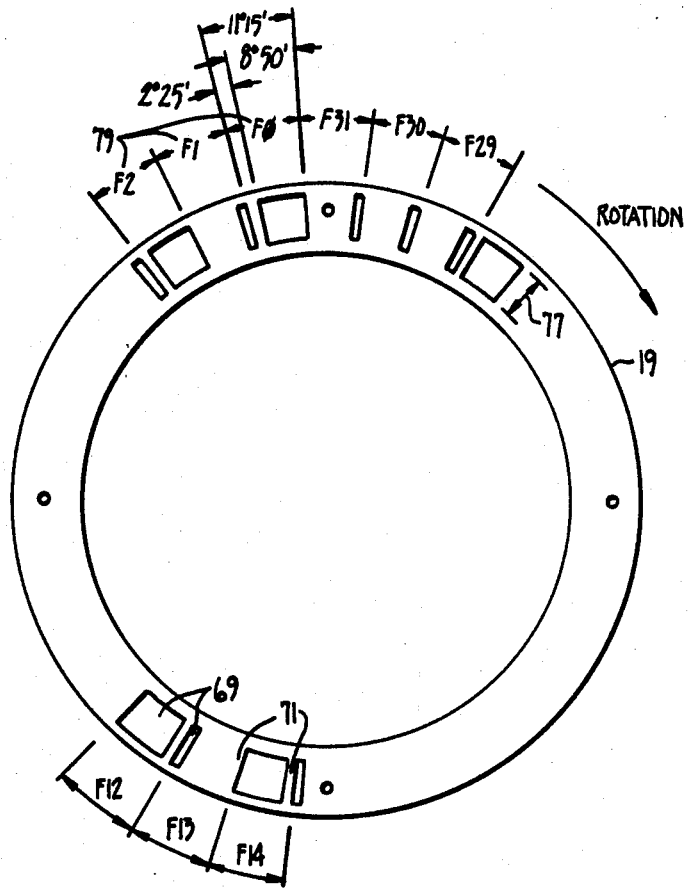
FIG. 5 is an elevational view of a coding ring used with each reel of the preferred embodiment to monitor its reel's rotation.

FIG. 5 illustrates the preferred construction of coding ring 19, which comprises a thin, stamped aluminum ring having a plurality of wide and narrow slots 69 stamped out of the ring at predetermined locations. Slots 69 are separated by wide and narrow opaque "bars" 71, or solid portions of the ring separating two adjacent slots. As seen in FIG. 3, sensor 25 comprises a U-shaped bracket which straddles sprocket 9, having an opposed pair of photo-optic elements consisting of an LED 73 on one arm of the U and a phototransistor 75 opposite LED 73, on the other arm of the U. LED 73 and phototransistor 75 are positioned in alignment with the slots 69 and bars 71 of coding disk 19, which form a single "track" 77 of information that may be read by the sensor 25 as reel 2 rotates, to monitor the reel's position and movement.

As reel 2 rotates, track 77 continuously passes between the photo-optic elements 73 and 75. LED 73 is pulsed at periodic intervals, and phototransistor 75 is sampled during these intervals, to determine whether or not it is receiving light from its opposed LED. If a bar 71, or opaque region of coding ring 19 is separating the photo-optic elements, the phototransistor 75 will indicate a "low" (digital zero) electrical state, while a slot 69 interposed between the photo-optic elements will permit light to pass from the LED 73 to the phototransistor 75, which will then indicate a "high" (digital one) electrical state. The rotation of reel 2 thus produces a digital signal at the output of phototransistor 75, modulated at the sampling frequency, having pulse widths that vary according to the speed of the rotating reel and the type (wide or narrow) of slot or bar presently between the photo-optic elements.

As seen in FIG. 5, track 77 is divided into thirty-two fields 79, corresponding to the thirty-two stopping positions defined by sprocket teeth 11, each field having an arcuate span, or "width," of 11°15'. Each field 79 is divided into two segments, one being a slot 69 and the other a bar 71. When the reel 2 is rotating in the proper direction (clockwise with respect to FIG. 5), the first segment of each field "seen" by sensor 25 will be a slot and the second segment will be a bar. The fields alternate between odd and even patterns, corresponding to the odd numbered and even numbered stopping positions of sprocket 9, with the exception of field F30, which has an odd pattern.

The first field, F0, which corresponds to the first stopping position of reel 2, contains an "even" pattern of a relatively wide slot 69 followed by a relatively narrow bar 71. In the embodiment described, a "wide" slot has the same arcuate span as a "wide" bar, occupying 8°50' of the 11°15' field width. Likewise, a "narrow" slot has the same arcuate span as a "narrow" bar, occupying 2°25' of the field width. Field F1, which corresponds to the second stopping position, displays an "odd" pattern of a narrow slot followed by a wide bar. Field F2 then repeats the even pattern of Field F0, and the sequence of alternating odd and even patterns continues about the circumference of coding ring 19 through field F29, which displays the odd pattern of a narrow slot followed by a wide bar. The next field, F30, contains another odd pattern, thus breaking the chain of alternating odd and even patterns. The last field, F31, also contains an odd pattern. Accordingly, the three sequential odd patterns of fields F29, F30 and F31 establish a "home" or "synch" position on the coding ring 19 which identifies the end of one complete revolution of the corresponding reel 2.

General Operation

A. Gameplay

In operation, a user initiates a round of game play with slot machine 1 by inserting a coin into coin slot 81 and pulling handle 83 forward. The movement of handle 83 closes a switch (not shown), causing a HANDLE PULLED signal to be transmitted to control circuit 29. The control circuit transmits a signal to start solenoids 53A, 53B and 53C, causing their respective pawl arms 31 to move from the REEL SET position to the REEL SPIN position described above, thus initiating a period of free wheeling reel spin for each of the three reels at a rate of approximately one revolution per second.

After handle 83 has been pulled, control circuit 29 generates three random numbers which are used to determine the next set of stopping positions for the three reels. Starting with the first reel, 2A, control circuit 29 loads the first random number into an aggregate number counter and samples sensor 25 at 500 microsecond intervals, to determine when the sampled output of phototransistor 75 undergoes a positive transition from a low to a high state, indicating the beginning of a new field. Each time a new field is sensed, control circuit 29 decrements the aggregate number counter and tests to see if the new aggregate number is greater than zero. When the aggregate number equals zero, control circuit 29 stops the spinning of reel 2A by transmitting a signal to energize its corresponding stopping solenoid 65. The second random number is then loaded into the aggregate number counter, and the countdown is repeated for reel 2B. When the aggregate number counter equals zero, reel 2B is stopped by energizing its corresponding stopping solenoid 65, and an aggregate number countdown is begun for reel 2C with the third random number. When the aggregate number counter again equals zero, the stopping solenoid 65 of reel 2C is energized to stop that reel and complete the round of game play. The stopping positions of reels 2A, 2B and 2C are then compared to a payout table and, if a winning combination is present, control circuit 29 indicates this fact to the user by means of an appropriate display 84 and/or payout of coins from an internal hopper (not shown) to coin receptacle 85.

After all three reels have stopped, control circuit 29 continues to sample phototransistors 75, at 500 microsecond intervals, during the "idle" mode in between rounds of game play. If a transition is sensed between any two successive samples of a given phototransistor during the idle mode, control circuit 29 transmits a "tilt" or error signal to indicate that improper reel movement has taken place, and inhibits subsequent game play until the tilt condition has been corrected.

During the above-described period of free wheeling reel spin, each reel is closely monitored to assure that its free spinning is not tampered with by the user. After a brief initialization period following the pulling of handle 83, the control circuit 29 performs a test every 500 microseconds to ensure that each reel has the proper rotational direction, speed, and acceleration, and to update the instantaneous rotational position of each reel.

Figure 6A:
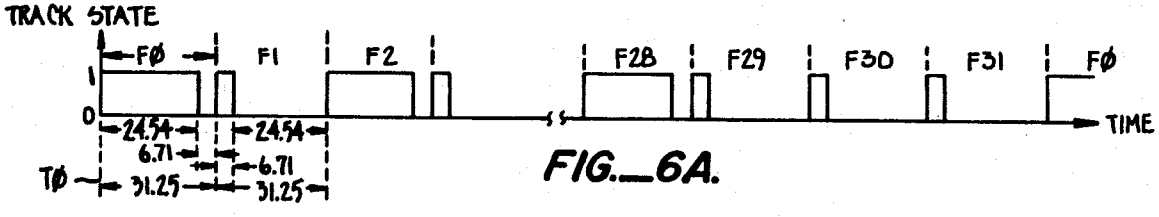
FIGS. 6A and 6B are timing diagrams of track state versus time for the coding ring of FIG. 5 during clockwise and counter-clockwise rotational movement.

The use of two different segment widths in each field of coding disk 19 enables control circuit 29 to monitor the rotational direction of each reel 2. FIG. 6A illustrates the pattern of slots 69 and bars 71 displayed by track 77 at a single, fixed point monitored by phototransistor 75, as reel 2 rotates in the correct (clockwise) direction at a constant rate of one revolution per second. At time zero (T0), field F0 begins to cross the single point, or "sensing zone" 87 upon which sensor 25 is focused. At this time, the state of track 77 undergoes a positive transition (from zero to 1), marking the start of a new field. The durations of the next two segments are monitored by control circuit 29, for use in determining the reel's rotational direction. When the next positive transition occurs (after 31.25 milliseconds), indicating the end of F0 and the beginning of F1, control circuit 29 compares the durations of the first and second segments of field F0. After determining that the first segment is longer (24.54 milliseconds versus 6.71 milliseconds), it divides the longer segment by two and compares the modified duration (12.27 milliseconds) to the shorter segment. Since the modified segment is still greater than the unmodified segment, control circuit 29 determines that the reel is spinning in the correct rotational direction, and repeats the computation for the next field.

Figure 6B:
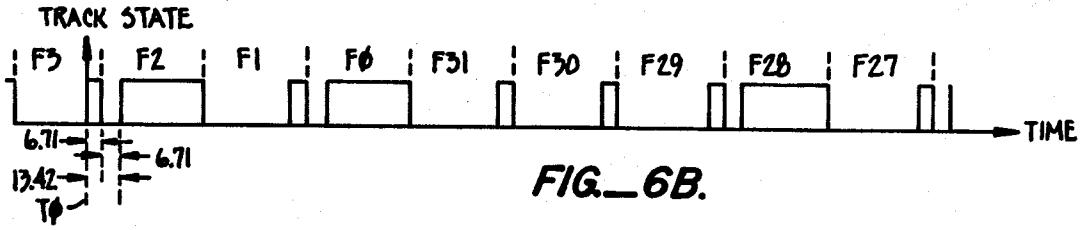

FIG. 6B is a graph of track state versus time for a reel which is spinning in the wrong (counter-clockwise) rotational direction at a constant rate of one revolution per second. At time zero (T0), a positive transition will be detected when the slot 69 of field F3 enters the sensing zone 87. Since control circuit 29 interprets this as the start of a new field 79, it will monitor the durations of the next two segments, and, at the next positive transition (13.2 milliseconds), will compare the segments to determine which is larger. In the present example, since the two segments are equal, one of them will be assigned a default status as the "larger segment," and will then be divided by two to provide a modified segment duration. The modified duration (3.355 milliseconds) will then be compared to the duration of the "shorter" segment (6.71 milliseconds) and, upon determining that it is not greater, control circuit 29 will issue an "error" or "tilt" signal indicating that the reel is not spinning in the correct rotational direction.

After determining that a given reel is spinning in the correct rotational direction, control circuit 29 compares the total duration of a prior field to a predetermined "minimum speed" duration, and issues an error signal if the reel is spinning at a rate less than the predetermined minimum rotational speed. The prior field duration is then compared to a predetermined "maximum speed" duration and an error signal is generated if the reel is spinning too fast.

Next, the durations of the prior and newly-completed fields are subtracted from each other and the difference is tested to determine whether the reel is accelerating or decelerating. If accelerating, the difference is tested against a maximum acceleration amount and, if greater, an error signal is generated. Likewise if the reel is decelerating, the difference is tested against a maximum deceleration amount and an error signal is generated if the reel is decelerating too quickly.

After testing for acceleration or deceleration, control circuit 29 determines whether the newly completed field contained an "odd" pattern (e.g. F1, F3, F5) or an "even" pattern (e.g. F0, F2, F4), by testing to see which one of the field's two segments was longer. If odd, it determines whether three sequential odd fields have been sensed, and if so, it clears a rotational position counter corresponding to that reel. If not, it increments the position counter and proceeds to the next reel, repeating the above-described test.

B. Diagnostic Tests

Slot machine 1 includes a feature which enables a service technician to rapidly diagnose many of the more frequent mechanical malfunctions in the rotation governing modules 27 and their associated reels 2. After each round of game play is finished, the slot machine enters an "idle" mode of operation, and remains there until the next coin is inserted, signaling the start of a new round of game play. During the idle mode, a series of diagnostic tests may be performed by opening door 28 and pressing switch 30. The slot machine then cycles through three successive tests designed to help the service technician diagnose whether various common machine malfunctions are present or imminent.

In the first test, all reels are spun and the above-mentioned tests for proper rotational direction, speed and acceleration are performed by control circuit 29 every 500 microseconds. If any of these parameters are unacceptable, an error message is displayed identifying which of the reels failed and which parameter caused the failure. After each reel has rotated past its home position at least once, its respective stopping solenoid is fired when the reel reaches a known stopping position, so the technician can confirm that the reel's stopping mechanism is operating properly. After all reels have been stopped, the program proceeds to the second diagnostic test.

In the second test, the first test is repeated with a shortened energization time period, or "solenoid on-time," for stopping solenoid 65 of each rotation governing module 27. Under normal operation, the stopping solenoids are each energized for a period of seven milliseconds to ensure sufficient time for their respective plungers to move their associated second trip levers 63. While an energization period of 4.5 milliseconds or less would be adequate to operate a stopping solenoid in good condition, accumulation of residue inside of a solenoid and wear caused by friction between the plunger and its mating surface may cause the response time to deteriorate. Consequently, normal slot machine operation provides a 2.5 millisecond safety margin, enabling the stopping solenoids to function even when substantial wear or accumulations of residue are present. The second diagnostic test eliminates this safety margin so that relatively small accumulations of residue will cause the machine's stopping solenoids to fail. The technician may then replace the faulty module(s) and take them to a service center for cleaning and inspection, thus increasing solenoid life and minimizing the possibility of a machine failure during normal game play.

When the second test is finished, microprocessor 89 automatically proceeds to the third diagnostic test in which the firing, or start of the seven millisecond energization period, of each stopping solenoid is delayed by six milliseconds to test the stop response time of modules 27. The stop response time is the time period required for the stopping solenoid 65 to react, and for pawl arm 31 to move from the COCKED position to the REEL SET position after the stopping solenoid releases it. When module 27 is operating smoothly, this stop response time is on the order of 12 milliseconds. Accordingly, pawl arm 31 is positioned relative to its associated sprocket 9 so that pin 33 will land in the bottom of a desired gap between teeth 11 approximately 12 milliseconds after the stopping solenoid is fired. The arrangement of teeth 11 is designed so that, with this timing, the stop response time can drag by over six milliseconds before causing pin 33 to skip to the next gap beyond the one in which it was supposed to have settled. During the third diagnostic test, the firing time of each stopping solenoid is delayed by six milliseconds. If the stop response time is substantially slower than 12 milliseconds, this delay will cause the pin 33 to skip to the next gap, corresponding to the next stopping position of its associated reel 2. After each reel has stopped, the microprocessor tests the digital state of phototransistor 75 to determine whether the reel's "parity" is correct. As discussed more fully below in conjunction with the Check Transistions subroutine of FIG. 9D, coding ring 19 is designed so that (with the exception of the three "home" fields) sequential stopping positions of reel 2 will cause alternate digital states to be present at the output of phototransistor 75. Since the correct stopping position of each reel during the diagnostic test is known in advance, the anticipated state of each phototransistor is also known, and may be used to determine whether or not a given reel has skipped to the next stopping position. If the anticipated state of the phototransistor matches the actual state, the reel's parity is established and the program proceeds to test the next reel. If any reel's parity is incorrect, an error message is displayed indicating that a skip has occurred at that reel number. If not, the program returns to the routine processing functions of the idle mode after the last reel's parity check is finished.

Control Circuit 29

FIG. 7 is a block diagram of a control circuit 29 constructed in accordance with the present invention. The embodiment shown employs an 8 bit microprocessor 89, such as an Intel 8031, to control and monitor the spinning and stopping of reels 2, as well as performing other processing operations, such as coin handling and audio-visual displays. A functional diagram of the Intel 8031 microprocessor, as well as its features, specifications, and instructions, may be found in the publication entitled "MCS 51 User's Manual," published by Intel Corporation in July, 1981, which is incorporated in this specification by reference. Terminals XTAL1 and XTAL2 of microprocessor 89 are connected to an exterior oscillator 91, which provides a 10 megahertz (MHz) signal to time the operations of microprocessor 89. Oscillator 91 is also connected to a serial I/O clock 93, for timing the input and output of serial data, as described more fully below.

Terminals D0 to D7 of microprocessor 89 are connected to an 8 bit data bus 95, which is used for transmission of data to and from a plurality of external apparatus such as sensors, solenoids, relays, and audio-visual displays. Data bus 95 also carries the eight lower order bits for addressing external memory, as described below.

Memory storage in control circuit 29 is distributed between the internal memory of microprocessor 89 and external memory storage provided by program memory 97 and external RAM 99. The internal memory of microprocessor 89 comprises an internal RAM having thirty-two general purpose registers for temporary storage, each holding one byte (eight bits) of information, and one hundred twenty eight assigned function registers, each holding one byte of information which is assigned to a specified memory function, such as storing the present rotational position of an associated reel 2.

Addressing of external memory is accomplished by data bus 95, lower address bus 101 (8 bits), upper address bus 103 (7 bits) and address latch 105. Address latch 105 comprises eight D-type latches with a common latch enable control gate L. Address latch 105 latches the eight bits of information from data bus 95 to lower address bus 101 when gate L is pulsed, and provide that information at its output after the latching pulse has been withdrawn.

Program memory 97 comprises a 16 kilobyte nonvolatile EPROM, which responds to an output enable pulse at terminal OE to access the memory location identified by upper and lower address busses 103 and 101, and transmit the 8 bit contents of that memory location to data bus 95. When microprocessor 89 is ready to receive a new instruction, it sends the eight lower address bits of the next instruction to terminals D0 to D7, and pulses terminal ALE (Address Latch Enable) so as to latch this data from data bus 95 onto lower address bus 101 via address latch 105. The microprocessor then sends the six upper order address bits of the next instruction to terminals A0 to A5, and transmits a pulse at terminal PSEN (Pulse Enable). Upon receipt of the signal from PSEN, program memory 97 will retrieve the next instruction (or eight bit portion of an instruction) from the address location identified by upper and lower address busses 103 and 101 and will load the eight bit contents of that address location onto data bus 95 for transmission to terminals D0 to D7 of the microprocessor.

External RAM 99 comprises a two kilobyte CMOS RAM which supplements the microprocessor's internal RAM and provides a temporary storage device for critical data in the event of a power failure, as will be discussed below. Since the CMOS RAM is a volatile memory device, a battery-powered electrical back up system 106 is provided to maintain the information in external RAM 99 in the event of a temporary power loss at its voltage supply terminal $V_S$. An example of such a battery backed CMOS memory device may be found in U.S. patent application Ser. No. 447,358 failed Dec. 6, 1982 (Device for Maintaining Game State Audit Trail Upon Instantaneous Power Failure), which is incorporated herein by reference. External RAM 99 responds to inputs from upper and lower address busses 103, 101 and Read/Write logic 107, so as to either store the byte of information on data bus 95 at the specified address or to transmit the contents of the addressed register to the data bus, for receipt by microprocessor 89 at terminals D0 to D7. When microprocessor 89 wishes to read the contents of a particular address location in external RAM 99, it loads the lower order address bits onto data bus 95 at terminals D0 to D7, and pulses terminal ALE to latch this information to lower order address bus 101. The microprocessor then loads the seven upper order address bits on upper address bus 103, which transmits the four least significant bits of the upper order address (at terminals A0 to A3) to external RAM 99, and transmits the three most significant bits of the upper order address (terminals A4 to A6) to Read/Write logic 107 while pulsing read terminal RD. Read/Write Logic 107 then demultiplexes the three coded bits of data from upper address bus 103 in conjunction with the pulse from the RD terminal and transmits a signal RX (Read external RAM) to external RAM 99. Upon receipt of the RX pulse, external RAM 99 will retrieve the contents stored at the 12 bit address location on address busses 103, 101 and output these contents to data bus 95 for receipt by the microprocessor at terminals D0 to D7.

When microprocessor 89 wishes to write, or store a byte of data at a given address location in external RAM 99, it again latches the lower order address information to lower order address bus 101 via address latch 105. Microprocessor 89 then transmits the four upper order address bits to terminals A0 to A3, and the three bit code for external RAM 99 to terminals A4 to A6. Read/Write Logic 107 then demultiplexes the external RAM code, and, in conjunction with a pulse from the write terminal WR of microprocessor 89, transmits a signal WX (Write to external RAM) to external RAM 99. At the same time, microprocessor 89 will load the eight bits of data it wishes to store in external RAM onto data bus 95 via terminals D0 to D7. Upon receipt of the WX signal, external RAM 99 will read the data from data bus 95 and store it at the twelve bit address location specified on data busses 103 and 101.

Figure 8:
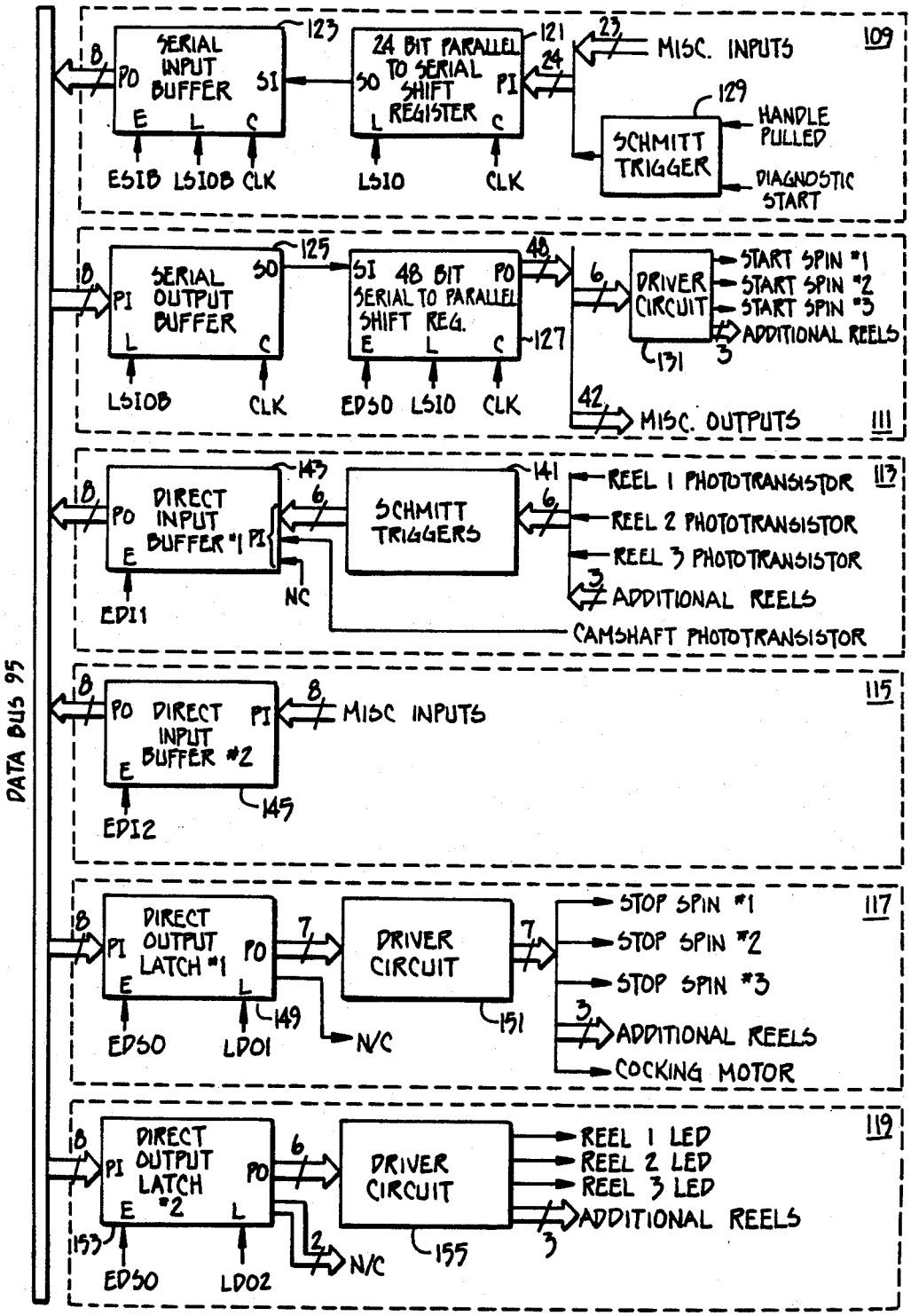
FIG. 8 is a schematic diagram illustrating the input and output circuitry of the control circuit of FIG. 7.

Read/Write Logic 107 is also used to demultiplex the signals from microprocessor 89 regarding serial and direct (parallel) input and output (I/O) to and from microprocessor 89. As seen in FIG. 7, microprocessor 89 communicates with external apparatus (such as sensors, solenoids, relays and audio-visual display) through serial input and output circuits 109 and 111, first and second direct input circuits 113 and 115, and first and second direct output circuits 117 and 119. A more detailed block diagram of these circuits is provided in FIG. 8 which illustrates the transfer of information to and from various circuit components of amusement machine 1.

Microprocessor 89 is programmed to transmit or receive data in one of two alternate manners, serially or directly, depending on the speed with which that data must be processed. Data which need not be processed immediately is handled in a serial manner and is updated every three milliseconds. On the other hand, data which must be processed more quickly than this is transmitted and received by microprocessor 89 in a direct manner, more fully described below.

The preferred embodiment of control circuit 29 provides 48 serial outputs and 18 serial inputs. While the following discussion will concentrate on the inputs and outputs used in performing the reel monitoring and diagnostic functions of the present invention, it will be understood that the control circuit 29 described must handle additional, or "miscellaneous" inputs and outputs such as sensors and audio-visual displays, which communicate with a user and/or serviceman to inform them of machine status conditions.

Serial input and output circuits 109, 111 operate in conjunction with clock pulses from serial clock 93, and latching and enabling pulses from Read/Write Logic 107, to communicate serial input and output information from and to microprocessor 89 on the eight bit databus 95.

Serial input circuit 109 uses a 24 bit parallel to serial shift register 121 to multiplex twenty-four separate digital input signals for transmission to microprocessor 89. Shift register 121 comprises a two stage device having twenty-four input terminals PI, one serial output terminal SO, a data latching terminal L, and a clock pulse terminal C. Upon receipt of signal LSIO (latch serial input/output) at terminal L, the data appearing on parallel input terminals PI of shift register 121 is latched into a first stage, twenty-four bit buffer, and applied to the inputs of a second stage, 24 bit parallel to serial shift register. With each subsequent clock pulse CLK received at terminal C of shift register 121, the latched data is shifted up by one bit, thus supplying the next bit of serial input data at terminal SO.

The output of shift register 121 is fed to the serial input terminal SI of serial input buffer 123, which buffers the serial data prior to its transmission to microprocessor 89. Serial input buffer 123 comprises a three stage device having a single serial input SI, eight parallel output terminals PO, and clock, latch and enable terminals C, L and E. The first stage of serial input buffer 123 comprises a serial to parallel eight bit shift register which shifts in the data appearing at terminal SI each time a clock pulse CLK is received at terminal C. The second stage of serial input buffer 123 comprises an eight bit latch which latches the eight bits of data from the first stage to the second stage outputs in response to latching pulse LSIOB (latch serial input/output buffer) at terminal L. After the second stage has latched the data from the first stage, subsequent clock pulses at terminal C may continue to shift in serial data without affecting the second stage output. The third stage of serial input buffer 123 comprises a three state (high, low or off) output buffer which responds to enabling signal ESIB (enable serial input buffer) so as to gate the second stage output bits to the eight parallel output terminal PO, and to provide a high impedance output (off) when terminal E is not being pulsed.

Serial output circuit 111 comprises a serial output buffer 125 which receives six successive bytes of data from microprocessor 89 via databus 95 and transfers it in serial form to a forty-eight bit serial to parallel shift register 127, which outputs the data in parallel form so as to control up to forty-eight external devices. Serial output buffer 125 comprises a two-stage, eight bit device which operates in a similar manner to the twenty-four bit parallel to serial shift register 121 discussed above. Serial output buffer 125 has eight parallel input terminals PI for receiving data from databus 95, a single serial output terminal SO for transmitting the data in serial form to forty-eight bit shift register 127, and latch and clock terminals L and C for controlling the transfer of information from parallel to serial form. Upon receipt of pulse LSIOB (latch serial I/O buffer) at terminal L of buffer 125, the eight bits of data at parallel inputs PI are latched into a first stage, 8 bit buffer and applied to the inputs of a second stage, 8 bit parallel to serial shift register. Subsequent receipt of clock pulses CLK at terminal C of serial output buffer 125 shifts the latched data to serial output terminal SO, through the second stage shift register, for transmission to forty-eight bit shift register 127.

Forty-eight bit shift register 127 comprises a three-stage device which operates in a similar manner to the eight bit serial input buffer 123. Shift register 127 has a serial input terminal SI, forty-eight parallel output terminals PO, and enable, latch, and clock terminals E, L and C for controlling the transfer of information between the three stages. Upon receipt of clock signal CLK at terminal C, the single bit of data at terminal SI is shifted into a first stage, serial to parallel shift register. After the first stage has been filled with forty-eight serial bits of data, the first stage outputs are latched to the second stage outputs upon receipt of pulse LSIO at terminal L. The third stage output buffer is responsive to signal EDSO (enable direct and serial outputs) for gating the second stage outputs to terminals PO, providing control signals for up to forty-eight external devices. Signal EDSO comprises a "watch-dog" signal, which enables all direct and serial outputs during normal operation of control circuit 29, and disables (or shuts down) all outputs in case of microprocessor program failure.

Serial I/O is performed in a six-part cycle, in accordance with a Serial I/O interrupt routine which performs one of the six-parts of the serial I/O cycle (hereafter I/O cycle") each time it is run. Microprocessor 89 is programmed to initiate a new Interrupt routine every 250 microseconds, which alternately performs a routine for controlling the spinning and stopping of reels 2 (hereafter "Reel Control Interrupt") or a routine for processing serial I/O (hereafter "Serial I/O Interrupt"). Accordingly, a new Serial I/O Interrupt is initiated every 500 microseconds, resulting in an I/O cycle of six Serial I/O Interrupts or three milliseconds. During each Serial I/O Interrupt, microprocessor 89 loads a new byte of serial output data on databus 95 and instructs I/O Logic 107 to "write" this data into serial output buffer 125 by sending a three bit serial buffer code to microprocessor terminals A4 to A6 and sending a "write" pulse to terminal WR. Read/Write Logic 107 demultiplexes these signals from microprocessor 89 and transmits pulse LSIOB (latch serial I/O buffer) to serial input buffer 123 and serial output buffer 125. This signal writes the byte on databus 95 into serial output buffer 125 by latching the byte into the buffer's first stage. At the same time, LSIOB latches one byte of serial input data from the first stage (serial to parallel shift register) to the second stage (octal latch) of serial input buffer 123, in preparation for the reading of this serial input byte by microprocessor 89. Next, the microprocessor reads the byte of serial information that was latched into serial input buffer 123 by pulsing terminal RD while providing the three bit serial buffer code at terminals A4 to A6. These signals are demultiplexed by Read/-Write Logic 107, which then transmits signal ESIB (enable serial input buffer) to serial input buffer 123 and to the reset terminal of serial clock 93. Upon receipt of ESIB, the byte of serial data which was latched into buffer 123 is delivered to databus 95 and read by the microprocessor at terminals D0 to D7.

ESIB is also used to reset serial counter 93 and initiate a new series of clock pulses CLK. Serial clock 93 receives a ten megahertz signal from oscillator 91, and, after dividing this signal to a lower frequency by conventional digital counting logic, outputs a clock signal CLK comprising an eight pulse "burst" which is emitted once every 500 milliseconds in response to the resetting of clock 93 by signal ESIB.

Clock signal CLK is transmitted to twenty-four bit shift register 121, serial input buffer 123, serial output buffer 125 and forty-eight bit shift register 127, to clock the flow of serial information through serial input and output circuits 109 and 111. Upon receipt of the eight bit pulse burst of CLK, eight bits of data are serially shifted out of twenty-four bit shift register 121 and into the first stage of serial input buffer 123. At the same time, the eight pulse burst of CLK clocks the eight bits of data in serial output buffer 125 into the first stage of forty-eight bit shift register 127. When the next Serial I/O Interrupt occurs, another byte of serial data is written into serial output buffer 125 from microprocessor 89, and the first stage data of serial input buffer 123 is latched into the second stage and read by the microprocessor. This process continues for six Serial I/O Interrupts, after which all twenty-four bits of shift register 121 will have been read into registers SINB1, SINB2 and SINB3 (serial input bytes 1, 2 and 3) of the microprocessor's internal RAM, and forty-eight bits of serial output will have been clocked into the first stage of shift register 127 from internal RAM registers SOUTB-1–SOUTB6 (serial output bytes 1–6). It will be understood that, while serial input buffer 123 is enabled during each Serial I/O Interrupt by pulsing ESIB, only three of the Serial I/O Interrupts in a six-part I/O cycle actually transfer serial input data to the microprocessor; accordingly, the "data" (or noise) enabled from serial input buffer 123 during the other three Serial I/O Interrupts is not stored in internal RAM.

At the start of the next Serial I/O Interrupt (the first Serial I/O Interrupt of the following I/O cycle), microprocessor 89 loads serial shift registers 121 and 127 with new data by sending a three bit code to terminals A4 to A6 and pulsing terminal RD. Read/Write Logic 107 demultiplexes these signals and transmits latching pulse LSIO (latch serial I/O) to serial shift registers 121 and 127. Following this latching operation, the forty-eight parallel output terminals PO of shift register 127 will contain the six bytes of serial output data sent by microprocessor 89 during the preceding I/O cycle, for use in controlling up to forty-eight external apparatus during the present I/O cycle, and shift register 121 will contain the latest sampling of data from its twenty-four parallel input terminals PI, to be shifted out and read by microprocessor 89 during the present I/O cycle.

Control circuit 29 now proceeds with another cycle of six Serial I/O Interrupts, repeating this cycle every three milliseconds to obtain updated samplings of the twenty-four input signals and provide updated control signals to its forty-eight serial outputs.

Of the twenty-four input signals appearing at terminals PI of twenty-four bit shift register 121, twenty-two signals comprise miscellaneous inputs which are unrelated to the present discussion, and will thus be referred to collectively in this specification. The remaining input signals are provided by handle 83 and diagnostic test switch 30. When handle 83 is pulled at the start of a round of game play, a switch (not shown) is closed, causing, a HANDLE PULLED signal to be sent to a corresponding one of Schmitt triggers 129. Likewise, when switch 30 is depressed, a DIAGNOSTIC START signal is sent to another of Schmitt triggers 129. Schmitt triggers 129 transform these to clean digital signals before transmitting them to two of the twenty-four parallel inputs PI of shift register 121. These two inputs will be transferred to two corresponding bits of internal RAM register SINB1 by the end of the following I/O cycle.

Of the forty-eight output signals appearing at parallel output terminals PO of forty-eight bit shift register 127, forty-two signals comprise miscellaneous outputs which are unrelated to the present invention, and will thus be referred to collectively in this specification. The remaining six signals are provided to a driver circuit 131, which amplifies the signals sufficiently to drive the coils of starting solenoids 53. Three of these six START SPIN signals correspond to the three start solenoids 53 in the embodiment being discussed, and the other three signals may be used to control to control the starting solenoids of up to three additional reels if desired.

The six START SPIN signals are set according to the respective states of six corresponding bits in register SOUTB1, as will be discussed more fully below, under the heading Operation of Microprocessor 89. It will be appreciated that the numbers assigned to the six serial output registers and three serial input registers in this specification (e.g., SOUTB1, SINB1) are arbitrarily chosen. As such, these numbers are neither intended to reflect a preferred order in the processing of the six serial output bytes or three serial input bytes, nor correspond to the order of the six serial output registers and three serial input registers of the annexed microfiche appendix.

Control circuit 29 also provides direct (parallel) input and output of two bytes of data to and from the internal RAM of microprocessor 89. While most functions of control circuit 29 may be performed once every three milliseconds in accordance with the I/O cycle, certain functions demand more rapid decision making and control capability in order to achieve the unique features of the present invention, such as the high-speed sampling of reel 2 by sensors 25. These functions are therefore controlled directly, outside of the I/O cycle by direct input circuits 113 and 115 and direct output circuits 117 and 119.

First direct input circuit 113 is used to transmit up to eight bits of data ("first direct input byte") regarding the state of reel phototransistors 75 and camshaft phototransistor 139 to microprocessor 89.

It will be noted that a while a three reel amusement machine is described herein for purposes of simplicity, control circuit 29 is designed so that it may be easily modified to accommodate up to three additional reels 2 by changing the microprocessor program instructions contained in program memory 97. In such a case, three of the four unused input bits of direct input circuit 113 may be used to monitor the phototransistors 75 of the additional reels. The fourth unused input bit will preferably not be connected, to simplify the programming of microprocessor 89. The six signals from reel phototransistors 75 are digitized by a set of six Schmitt triggers 141 and delivered to the parallel inputs PI of first direct input buffer 143, along with the input signal from camshaft phototransistor 139. Buffer 143 comprises an octal, three state buffer (low, high and "off") which transmits the eight bits of information at input terminals PI to output terminals PO in response to an enabling pulse at terminal E. When microprocessor 89 wishes to sample the first direct input byte, it transmits a three bit code corresponding to direct input circuit 113 to terminals A4 to A6, and pulses terminal RD. Read/Write Logic 107 demultiplexes the signals and transmits pulse EDI1 (enable direct input 1) to first direct input buffer 143, which transmits its byte of data to terminals D0 to D7 of microprocessor 89 via databus 95.

Second direct input circuit 115 operates in a similar manner to first direct input circuit 113 to transmit a second byte of direct input data ("second direct input byte") to microprocessor 89. Circuit 115 comprises a second direct input buffer 145 which functions in the same manner as first direct input buffer 143. Parallel input terminals PI of buffer 145 are connected to eight miscellaneous inputs, such as a phototransistor (not shown) for detecting the open or closed state of door 28, which accesses the interior of machine housing 147. When microprocessor 89 wishes to read the second direct input byte, it issures a three bit code to terminals A4 to A6 corresponding to second direct input circuit 115, and pulses terminal RD. I/O Logic 107 demultiplexes the signal and transmits pulse EDI2 (enable direct input 2) to the enabling gate E of buffer 145, causing the second direct input byte to be transmitted to terminals D0 to D7 of the microprocessor 89 via databus 95.

First and second direct output circuits 117 and 119 are used to output first and second bytes of control data to external apparatus requiring control signals at a faster rate than the three millisecond period of the I/O cycle. The first such byte of data ("first direct output byte") controls the energization of stop solenoids 65 and the on/off state of cocking motor 52. The second direct output byte controls the on/off state of LEDs 73 in sensors 25.

First direct output circuit 117 comprises a first direct output latch 149 comprising a two stage device for storing and transmitting the first direct output byte from microprocessor 89. The first stage comprises an octal latch which responds to a latching signal at terminal L for latching the data at input terminals PI to the first stage outputs. The second stage comprises a three state buffer which responds to an enabling signal at terminal E for gating the data from the first stage outputs to parallel output terminals PO. This data is then amplified by driver circuit 151 and sent to stopping solenoids 65 and cocking motor 52. When microprocessor 89 wishes to update the first direct output byte, it issues a three bit code corresponding to first direct output latch 149 to terminals A4 to A6 and pulses write terminal WR. I/O Logic 107 demultiplexes these signals and transmits latching pulse LDO1 (latch direct output 1) to first direct output latch 149. At the same time, microprocessor 89 transmits the byte of data at internal RAM register DOUTB1 (direct output byte 1) to terminals D0 to D7. This byte contains three bits corresponding to the three stopping solenoids 65 in the embodiment being discussed, and three bits which may be used to control the stopping solenoids of up to three additional reels. One bit is also used to control cocking motor 52. The remaining bit is preferably not connected, to simplify microprocessor programming.

Upon receipt of latching pulse LDO1, output latch 149 latches the data from DOUTB1 into its first stage. As discussed above, enabling signal EDSO is normally present, except in case of microprocessor program failure. Accordingly, the latched data is normally transmitted to output terminals PO, then amplified by driver circuit 151 and transmitted to stopping solenoids 65 and cocking motor 52. If the microprocessor program fails, EDSO is withdrawn and the second stage buffer of latch 149 is disabled, switching all outputs of latch 149 to a high impedance ("off") state.

Second direct output circuit 119 has similar circuitry to first direct output circuit 117, including a second direct output latch 153 and associated driver circuit 155. Second direct output latch 153 operates in the same manner as first direct output latch 149, responding to a latching signal at terminal L for latching data into its first stage and to an enabling signal at terminal E for enabling a second stage buffer to output the latched data. When microprocessor 89 wishes to update the second direct output byte, it transfers a byte of data to terminals D0 to D7, issues a three bit code corresponding to second direct output circuit 119 to terminals A4 to A6, and pulses write terminal WR. Read/Write Logic 107 demultiplexes the signals and transmits pulse LDO2 (Latch Direct Output 2) to terminal L of output latch 153, causing the second direct output byte to be latched into the first stage of second direct output latch 153. This byte contains three bits corresponding to the three LEDs 73 in the embodiment being discussed, and three bits which may be used to control the LEDs of up to three additional reels. The remaining two bits are preferably not connected, to simplify microprocessor programming.

Since enabling signal EDSO is normally present, the latched data will normally be passed through the second stage of second direct output latch 153 to driver circuit 155, which amplifies the signals and transmits them to LEDs 73. If the microprocessor program fails, signal EDSO will be withdrawn and the second stage buffer of latch 153 will be disabled, turning off the outputs of second direct output circuit 119.

Operation of Microprocessor 89

Microprocessor 89 operates in accordance with a program which is stored in program memory 97. The sequence of steps performed by microprocessor 89 in accordance with the present invention is depicted in the flow charts of FIGS. 9 to 11. It will be appreciated that the a program capable of carrying out the sequence of events depicted in these flow charts may take a wide variety of forms in accordance with the techniques of the individual programmer and the desired functions to be performed by the microprocessor in addition to the reel monitoring, reel control and diagnostic functions described below. However, in order to provide an example of one type of such program and associated circuitry presently being used by the applicant, the circuit diagrams and object code of a working embodiment of the invention are submitted with this specification as a microfiche appendix.

The operation of microprocessor 89 proceeds in accordance with a main program and a series of periodic Interrupt routines. Upon completion of a particular Interrupt routine, the microprocessor returns to the last instruction of the main program from which the Interrupt occurred, and proceeds to process the main program until another Interrupt request is received. The annexed drawings have been organized in accordance with this distinction, with FIGS. 9A to 9D and 11A to 11D illustrating flow charts of the main program, and FIGS. 10A to 10E illustrating the Interrupt routine.

More specifically, the flow charts of FIG. 9 illustrate the sequence of microprocessor steps directed by the main program after a round of gameplay has been initiated by pulling handle 83. FIGS. 10A to 10D refer to the Reel Control Interrupt portion of the Interrupt routine, and FIG. 10E refers to the Serial I/O Interrupt portion. It will be appreciated that, when the term "Interrupt routine" is used in this specification without the designation "Reel Control" or "Serial I/O," it is intended to refer to the entire Interrupt routine illustrated in FIGS. 10A–10E. The flow charts of FIG. 11 illustrate the sequence of steps directed by the main program during a diagnostic routine, which may be initiated by a technician to determine whether servicing is necessary.

The main program depicted in FIGS. 9 and 11 is performed in a number of states, each processing information relating to a particular function of the amusement machine 1. For example, one state may control data processing during an "idle" mode in between rounds of game play, as discussed more fully below in conjunction with the Diagnostic Test Routine of FIG. 11. Another state may control machine operations after a player has inserted a coin, another state may evaluate the amount of money to be paid following a round of game play, and so on. These states may be referred to as "non-reel spin states," as they involve data processing operations which take place either before or after the spinning of reels 2 in a round of game play. These operations are referred to at step A1 of FIG. 9A, which illustrates the flow chart for initiating a reel spinning operation. At various points during the processing of the non-reel spin states, the microprocessor tests to determine if the handle 83 has been pulled, as indicated at step A2. If it has not been pulled, the program continues to process the non-reel spin states, until the next point is reached at which the microprocessor again tests to see if handle 83 has been pulled. More specifically, one of the twenty-four bits of serial input registers SINB-1–SINB3 is designated as the HP (handle pulled) flag. When handle 83 is pulled, the corresponding bit in shift register 121 is set upon receipt of signal LSIO, and the following I/O cycle transfers the content of that bit to flag HP. At step A2 in FIG. 9, the microprocessor tests HP and, if it is set, proceeds to the reel spin state which begins at the following step A2(a).

At step A2(a), microprocessor 89 stores a code number in eight bit CMOS register STATE/C (the notation "/C" will be used to indicate memory locations in CMOS external RAM 99) corresponding to the Reel Spin state. As discussed below, this register will be accessed after any power interruptions to determine whether the power was cutoff during the Reel Spin state.

At step A3, the microprocessor clears eight bit register XTRATR (extra transitions) and a bit, or "soft error flag" in eight bit register SOFTEN (Soft Error Enable) corresponding to each of the three reels is set, in preparation for a reel spinning operation. XTRATR and SOFTEN are used in connection with "soft error" processing, which is performed after each reel has stopped spinning to determine whether it has actually stopped at the rotational position counted by the microprocessor.

As discussed above, the signal to energize, or "fire" a given stop solenoid is sent when the field 79 of coding disc 19 on which the reel 2 is supposed to stop enters the sensing zone 87 of that reel's sensor 25. Since sampling of sensor 25 occurs every 500 microseconds, processing of the STOP SOLENOID signal is virtually instantaneous with respect to the 31.25 millisecond time period for passage of each field 79 during free wheeling reel spin. Consequently, the only substantial delay which occurs before the reel stops spinning is the stop response time, which is required for the stop solenoid to react and for the pawl arm 31 to move from the COCKED position to the REEL SET position after the stop solenoid releases it. This stop response time is normally on the order of 12 milliseconds, so, under normal stopping conditions, control circuit 29 should not sense any positive track state transitions after the stop solenoid pulse has been sent.

However, two factors may combine during the stopping of a reel to create a "false" positive transition; i.e., one which does not coincide with the entry of a new field 79 into sensing zone 87. The first such factor is an increased stop response time, which may result when slow solenoid response or abnormal pawl arm friction causes the pawl arm 31 to take longer than 12 milliseconds to move from the COCKED to the REEL SET position after the STOP SOLENOID pulse issues. In an extreme case, pin 33 may contact sprocket 9 just before the tip 157 (see FIG. 2) of the tooth 159 before which it was supposed to stop. This would allow sprocket 9 to rotate past the intended stopping point before being contacted by pin 33, and would then cause the sprocket to reverse its rotational direction as pin 33 moved from the tip of tooth 159 into the gap between teeth 159 and 161 (position A in FIG. 2).

The second factor which may contribute to a false positive transition is the springing action which occurs when the inertial movement of a spinning reel is abruptly stopped by pawl arm 31. In particular, the stopping of reel 2 causes flexing in resilient stop head 32

(FIG. 2) and axle 164 (FIG. 1) which allows sprocket 9 to move slightly past the position at which it is first contacted by pin 33, and then snap back (in the reverse rotational direction) after the rotational inertia of the spinning reel has been absorbed.

Since the above two factors permit some degree of overtravel in sprocket 9, it may be possible for a false positive transition to occur when a reel is stopping on an even field (other than F30). As seen in FIG. 6A, all even fields of coding disc 19, except F30, have an "even" field pattern defined by a wide (8°50') slot (digital track state "1") followed by a narrow (2°25') bar (state "0"), and all odd fields have an "odd" field pattern defined by a narrow slot followed by a wide bar. Accordingly, when sprocket 9 is being stopped on an even field pattern, it is possible for the sprocket to rotate beyond the negative transition at the end of the wide slot, then reverse its direction and snap back to the desired stopping position, causing a position transition. "Soft error" processing allows this to occur without issuing an error signal, and without incrementing the reel's corresponding 8-bit position counter RL(N)POS (reel "N" position) in internal RAM, as it usually does after a positive transition.

On the other hand, if the positive transition was the result of an exceedingly slow stop response time, causing pawl arm 31 to engage sprocket 9 after skipping past tooth 159, soft error processing will recognize this and increment the reel's position counter without issuing an error signal. In the preferred embodiment, the amount of overtravel resulting from mechanical flexion is sufficiently small that, if the track state undergoes a positive transition after the stop solenoid has been fired on an odd field pattern, it is certain that pin 33 has contacted tooth 159 after passing its tip 157. In this case, since sprocket 9 will continue to rotate until pin 33 lodges in the gap 163 beyond tooth 159, soft error processing will recognize this as a "true" positive transition and will therefore increment the reel's position counter. An error signal will only be generated if (after firing the stop solenoid on either an odd or even field) two positive transitions are detected before the sprocket comes to rest.

After enabling soft error processing at step A3 of FIG. 9 by clearing XTRATR and setting the reel bits in SOFTEN, the main program proceeds to step A4, in which three bits, or "reel start flags" corresponding to each of the three reels, are set in an eight bit register RLSTRT (reel start) of internal RAM, to be used during the following Reel Control Interrupt for firing the three starting solenoids 53.

The main program then proceeds to step A5 in which a one bit flag SPINIT (spin initialization) is set in internal RAM. This starts a spin initialization period during which the reels are spun, or "kicked" by their respective pawl arms 31, and their tracks 77 are sampled by sensors 25, but none of the rotation testing functions (direction, speed and acceleration) are performed, thus allowing the reels to reach a constant rotational speed without generating an error signal.

In order to facilitate a description of the steps performed by the main program in FIGS. 9 and 11 and by the Interrupt routine in FIG. 10, it will be necessary to refer to reels 2A, 2B and 2C, respectively, as Reel (0), Reel (1) and Reel (2) in the following program description. It should be noted that the numbers 0, 1 and 2 used in this context are not to be confused with the reference numbers 2A, 2B and 2C of their corresponding reels, as set forth above with reference to FIG. 1.

At the next step A6, the main program instructs microprocessor 89 to generate three random numbers and store them in internal RAM registers RN0, RN1, and RN2 (random numbers 0, 1 and 2). The first random number, which is associated with the first reel (Reel (0), or reference number 2A) is selected with a lower limit of 32 and an upper limit of 63, so that the first reel will make at least one full revolution (32 fields) before it is stopped. This assures that the synch position of fields F29, F30 and F31 will pass sensor 25 of Reel (0) at least once, to establish the correct rotational position in counter RL(0)POS. The second and third random numbers, which are respectively associated with the second reel (Reel (1), or 2B) and third level (Reel (2), or 2C), are selected with a lower limit of six and an upper limit of eleven (all references to numbers other than 0 or 1 in this specification are in decimal, or base 10 notation). Since the second and third random numbers are sequentially counted down after the first random number, their respective reels will have already rotated at least one revolution before being counted down, and a lower limit of zero could be set without adverse effect. A lower limit of eight is preferred, though, so as to emphasize the sequential reel stopping effect familiar to slot machine users.

At step A6a, the microprocessor clears an 8-bit CMOS register SGLTRF/C (single transistor flag in CMOS external RAM 99). This register contains a one-bit "single transition flag" for each reel, which will be used during subsequent Interrupt routines to determine whether its corresponding reel began spinning after it was kicked.

At step A7, the main program loops for 50 milliseconds while the reels are kicked. The 50 millisecond delay allows the pawl arms 31 to finish traveling from their respective REEL SET to REEL SPIN positions before starting cocking motor 52.

At step A8, one of the bits of first direct output byte DOUTB1 corresponding to cocking motor 52 is set, enabling the cocking motor to be turned on during the following I/O Interrupt. The main program then loops for 350 milliseconds at step A9 to allow sufficient time for cocking motor 52 to move camshaft positioning disc 68 off the "home" position provided by finger 66. It then tests register LASTVAL at step A10 to determine whether the motor 52 has moved. LASTVAL (last value) is an eight bit register in internal RAM which stores the state of the inputs to direct input circuit 113 during the last Reel Control Interrupt. Accordingly, one of the bits in LASTVAL coontains the most recent sample of phototransistor 139 in camshaft sensor 64. If this bit is high, microprocessor 89 determines that camshaft positioning disc 68 has moved off the home position, so motor 52 is functioning properly. If it is low, this indicates finger 66 is blocking the path of light from LED 165 to phototransistor 139, and that cocking motor 52 is either stopped or moving too slowly, thus requiring servicing.

If camshaft positioning disc 68 has moved off home at step A10, the main program clears the SPINIT flag at step A11 so that all rotation testing functions may now be performed during subsequent Reel Control Interrupts. The main program then proceeds to step A12 and performs the Reel Monitor routine, discussed below.

If disc 68 has not moved off home at step A10, the cocking motor bit of register DOUTB1 is cleared at step A13, enabling motor 52 to be turned off during the next Reel Control Interrupt. The program then loads a Motor Tilt Error code into the microprocessor's accumulator, and tests at step A15 to see if a tilt (from another source of error) is already in progress. If not, the program branches to a Process Tilt routine at step A16, as is well known in the art. In the Process Tilt routine, control circuit 29 stops normal operations and sends a MOTOR TILT error signal to a location, such as a memory register or LED, which may be checked by a service person to determine the cause of the tilt condition.

Reel Monitor Routine

Figure 9A:
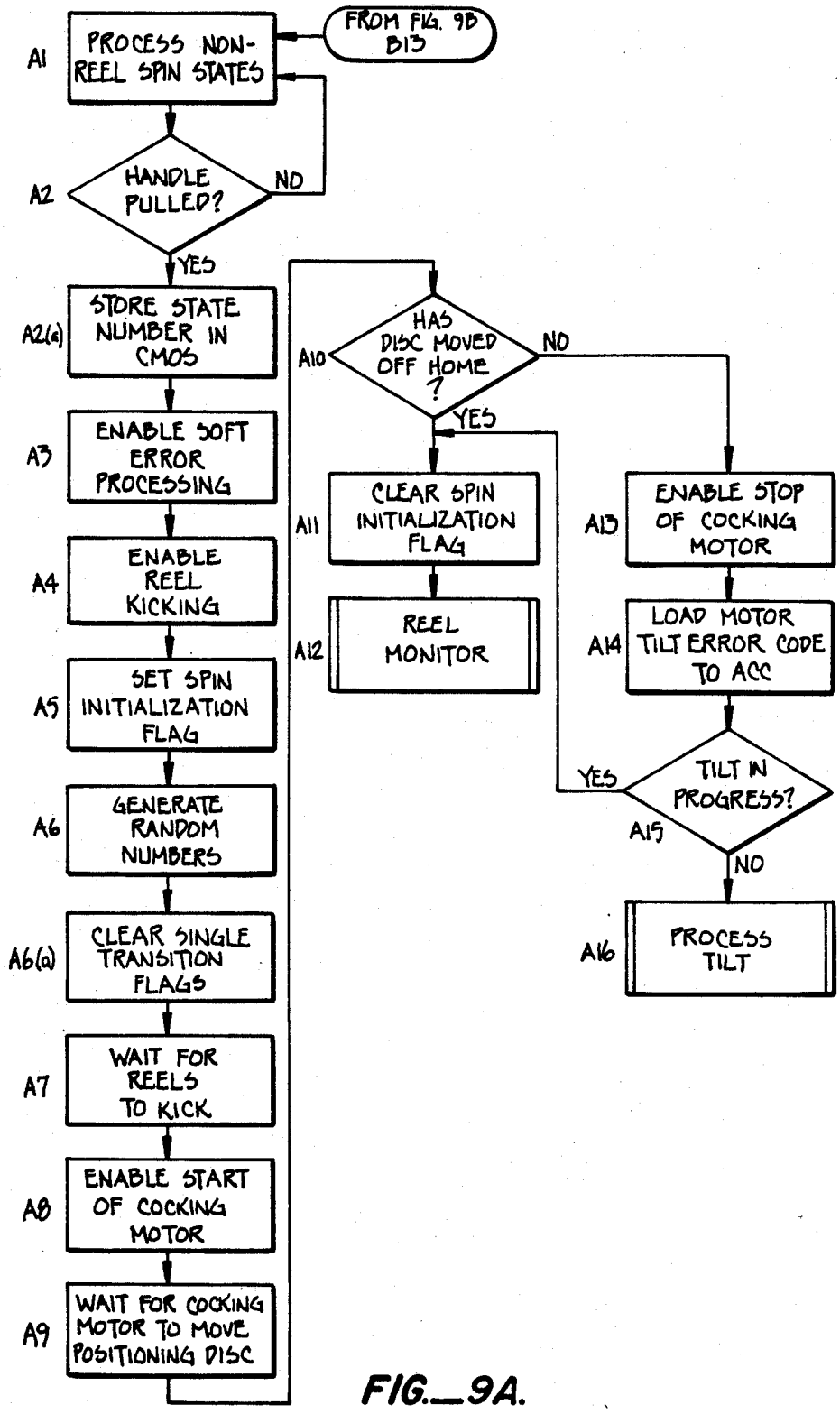
FIGS. 9A to 9D are flow charts illustrating the processing steps performed by the microprocessor of FIG. 7 during the main program.
Figure 9B:
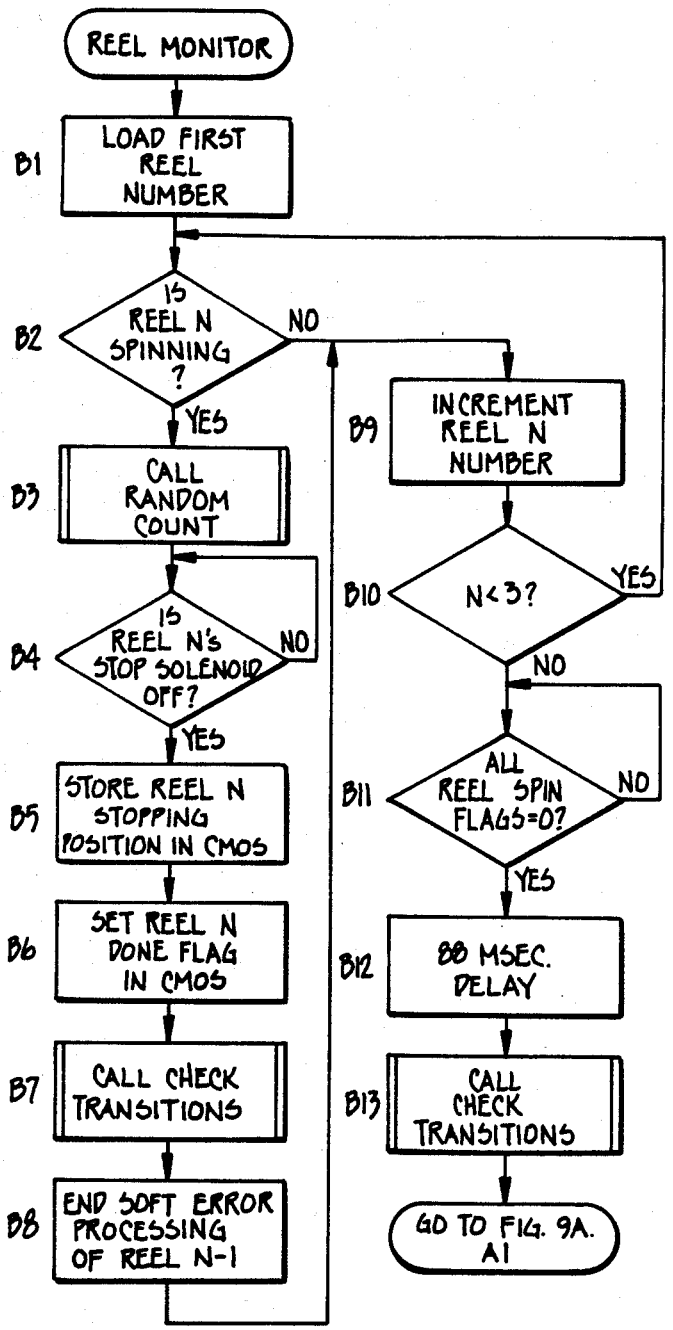
Figure 9C:
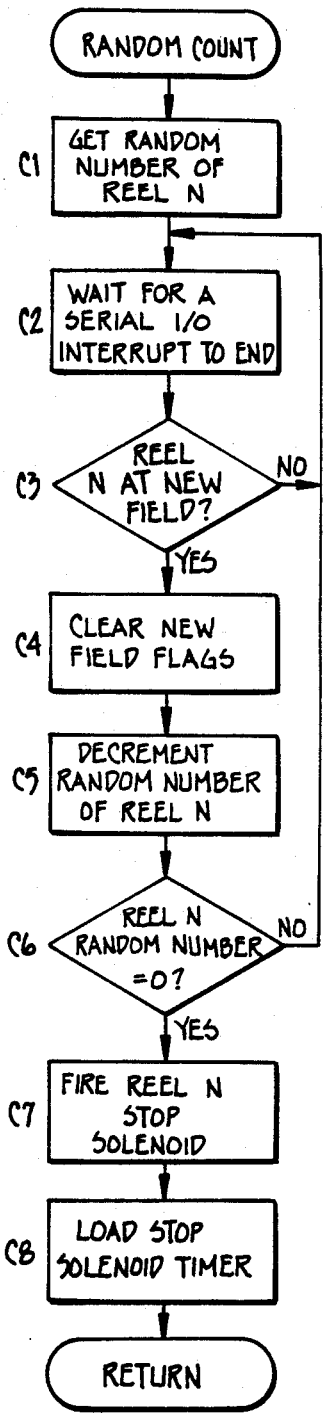
Figure 9D:
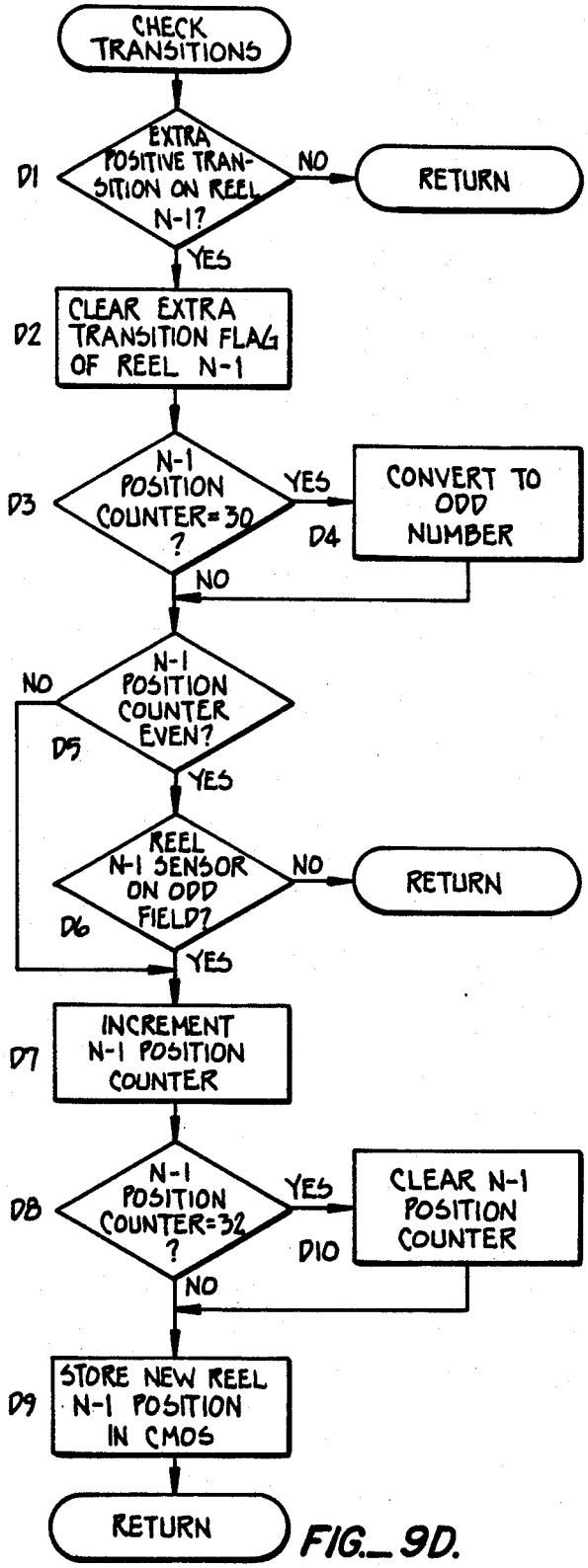

FIGS. 9B–9D illustrate the operational steps of microprocessor 89 in the Reel Monitor Routine, and its imbedded Random Count and Check Transistions subroutines. During the Reel Monitor routine the main program counts down the generated random number for each reel in conjunction with Interrupt routines that monitor the reel's rotational position, then stops the reel and checks to make sure it has stopped at the intended rotational position.

At step B1, the number 0 is loaded into a general purpose register TEMP1 (the notation TEMPX will be used to identify general purpose, or "temporary" register number X) in internal RAM corresponding to Reel (0), the first reel to be counted down. After each reel has been counted down, the number N in TEMP1 will be incremented by one to indicate which reel is presently being monitored. Thus if N=0, the routine will monitor reel 2A; if N=1, it will monitor reel 2B; and if N=2, it will monitor reel 2C.

At step B2, the program determines whether reel "N" (the reel whose number is in TEMP1; in this case Reel (0)) is spinning by testing register RLSPNF (reel spin flag) to see whether the bit corresponding to Reel (N) has been set. RLSPNF is an eight bit register in internal RAM which is set in the first Reel Control Interrupt after handle 83 is pulled, and cleared one bit at a time in the Interrupt routines as the stopping solenoid 65 corresponding to that bit is fired. If the Reel "N" bit of RLSPNF is set, the program proceeds to step B3 at which the Random Count subroutine is called. Random Count, which will be discussed below with reference to FIG. 9C, obtains the random number which has been generated for Reel (N), decrements it each time a new field passes sensor 25, and enables the firing of Reel (N)'s stopping solenoid 65. It then returns the program to step B4 of FIG. 9B, where the program again tests the Reel (N) bit of RLSPNF, and loops until it is cleared (in an Interrupt routine), indicating that the stopping solenoid of Reel (N) has been de-energized and the reel is not (or should not be) spinning.

At step B5, the contents of reel position counter RL(N)POS are transmitted to regiister RL(N)POS/C in CMOS External RAM 99, to preserve its contents in case of a power interruption that would otherwise erase the data in the microprocessor's volatile internal RAM. When the reels are spinning, control circuit 29 samples sensor 25 of each reel during each Reel Control Interrupt. If one of the reels has moved to a new field, the contents of that reel's position counter are incremented by one to indicate the present rotational position of its corresponding reel. Accordingly, by transferring these contents to CMOS memory at step B5, after Reel (N) has stopped, the microprocessor will be able to determine whether that reel moved while power was off, and take appropriate action as discussed below.

At step B6, a bit corresponding to Reel (N) is set in eight bit CMOS register DONE/C to indicate that reel has been done (i.e., spun to a new rotational position and stopped). In the event of a power interruption, the microprocessor will follow a power-on procedure in which it first chceks register STATE/C to see if the Reel Spin state was being processed when the power was interrupted. If so, it tests register DONE/C to see if all the reel bits of that register were set. If not, the microprocessor generates new random numbers for the reels which were not set (i.e., had not finished spinning when the power was cut off), respins those reels and stops them according to their new random numbers. The microprocessor also respins the reels whose DONE/C bits were set, but does not generate new random numbers; these reels are stopped at the same position they were in when the power was interrupted, as stored in register RL(N)POS/C corresponding to each such reel.

If all the reel bits of DONE/C were set before the power was interrupted, or if the microprocessor was not in the Reel Spin state, the microprocessor respins all reels and returns them to the positions stored in RL(N)POS/C, where they were stopped before the power interruption occurred.

After the Reel (N) bit of register DONE/C has been set at step B6 of the Reel Monitor routine, the main program proceeds to step B7 at which the Check Transitions subroutine is called. The Check Transitions subroutine, which will be discussed below with reference to FIG. 9D, is used in conjunction with register XTRATR to determine whether the reel which was stopped in the previous iteration of Reel Monitor routine steps B2 to B10 (i.e., Reel (N-1)) has made an extra positive field state transition, and if so, to determine whether that reel's position counter RL(N-1)POS should be corrected.

After the main program has returned from the Check Transitions subroutine of step B7, it proceeds to B8 at which the bit corresponding to Reel (N-1) in the SOFTEN register is cleared. This signifies the end of soft error processing for Reel (N-1) so that, if any positive transitions are sensed for that reel after this point, an error signal will issue indicating that the reel moved after it was supposed to have stopped.

The Reel Monitor routine then proceeds to step B9, in which the value of register TEMP1 (which contains the number of Reel (N)) is incremented by one, corresponding to the number of the next reel to be monitored. At step B10, the program tests to see if the contents of TEMP1 are less than three, and if so, it branches back to step B2, to repeat steps B2 through B10 for the next successive reel. If the value of TEMP1 is equal to three, indicating that the stopping solenoid 65 of the third reel has just been turned off, the program proceeds to step B11, where it loops until the last reel spin flag (the bit of RLSPNF corresponding to Reel (2)) has cleared during an Interrupt routine. The program then proceeds to step B12, at which a delay of approximately 88 milliseconds is processed to insure that the last reel has stopped moving. The program then proceeds to step B13, at which the Check Transitions subroutine is called for the last reel. When the program returns from the Check Transitions subroutine, it returns to step A1 of FIG. 9A, to proceed with processing of the non-reel spin states.

FIG. 9C illustrates the processing sequence of the Random Count subroutine which is called at step B3 of the Reel Monitor routine. At step C1, the Random Count subroutine accesses register RN(N), which contains the random number which was generated for Reel (N) at step A6 of FIG. 9A. This random number is then stored in general purpose register TEMP2, which will be used as the "aggregate number counter" for Reel (N) during the Random Count subroutine. It will be recalled that the random number for Reel (0) is selected in the range of 32 to 63, and the random numbers of Reels (1) and (2) are selected in the range of 6 to 11. The program then proceeds to step C2 where it loops until the next Serial I/O Interrupt is completed. At step C3, after completion of an I/O Interrupt has been detected, the program accesses register NUFLD (new field) and determines whether the Reel (N) bit of that register is set. NUFLD is an eight bit register in internal RAM having one bit, or "new field flag," allocated to each reel. During each Reel Control Interrupt, the microprocessor determines whether the field state of any reel has undergone a positive transition, and if so, sets that reel's corresponding flag in NUFLD for use during the Random Count subroutine. If it is determined at step C3 that the Reel (N) flag of NUFLD is not set, the program returns to step C2 and loops between steps C2 and C3 until it determines that the Reel (N) flag of NUFLD is set. It then proceeds to step C4, at which all new field flags in register NUFLD are cleared. At step C5, the random number of Reel (N) is counted down by decrementing the contents of register TEMP2 by one. Thus, register TEMP2 keeps track of the aggregate number of fields of Reel (N) that have passed its sensor 25 since the start of the Random Count subroutine.

At step C6, the microprocessor determines whether the number stored in TEMP2 is equal to zero, and if not, returns to step C2. The program then loops between steps C2 to C6 until TEMP2 equals zero, at which point Reel (N) will have rotated through a number of fields equal to the random number stored in its respective register RN(N). The program then proceeds to step C7, at which Reel (N)'s stopping solenoid 65 is fired. More specifically, the microprocessor accesses register DOUTB1 and sets the Reel (N) bit of that register. It then transmits the new value of DOUTB1 to microprocessor terminals D0 to D7, issues the three bit code corresponding to first direct output circuit 117 to terminals A4 to A6, and pulses write terminal WR. Read/-Write Logic 107 then transmits pulse LDO1 which latches the new value of DOUTB1 to first direct output circuit 117 via databus 95, causing the STOP SPIN signal to be sent to the stopping solenoid 65 of Reel (N). At step C8, register SONTMR (solenoid on timer) is loaded with the binary equivalent of decimal number 14. SONTMR is an eight bit internal RAM register which is used during the interrupt routines to time the duration of the STOP SOLENOID signal, which energizes the appropriate stopping solenoid 65 for a period of seven milliseconds. After SONTMR has been loaded, the program leaves the Random Count subroutine and returns to step B3 of the Reel Monitor routine from which it was called.

FIG. 9D is a flow chart of the Check Transitions subroutine which is called from the Reel Monitor routine at steps B7 and B13. At step D1 of the Check Transitions subroutine, the microprocessor tests the Reel (N-1)) bit of register XTRATR, to determine if the track state of that reel has made a single positive transition since the reel's stopping solenoid 65 was fired. It will be recalled that XTRATR was cleared at step A3 of the main program, in conjunction with the enablement of "soft error" processing. Thereafter, so long as soft error processing is in effect (as determined by register SOFTEN), a one bit extra transition flag corresponding to a given reel is set in XTRATR during an Interrupt routine if that reel's sensor 25 detects a positive track state transition after its stopping solenoid 65 has been fired. If a second positive transition is detected, an error signal indicating improper reel movement is sent. However, if only one positive transition is detected during soft error processing, the microprocessor does not issue an error signal since, as discussed above, the transition may be a "false" positive transition. In this case, the Check Transition subroutine is used to determine whether a true or false positive transition has occurred and to set the reel's position counter accordingly.

Since the microprocessor processes instructions at an extremely high rate of speed compared to the rotational speed of the reels, the Check Transitions subroutine cannot be performed for a given reel immediately after that reel's stopping solenoid has been fired, as the reel may not yet have settled into its final stopping position. Accordingly, after the stopping solenoid 65 for Reel (N) has been fired (at step C7 of Random Count), the Check Transitions subroutine tests Reel (N-1), which settled into its final stopping position while Reel (N) was spinning. If Reel (N) is the first reel 2A (N=0), or if the Reel (N-1) extra transition flag is not set, the program returns to the step of the Reel Monitor routine from which the Check Transitions subroutine was called (either step B7 or B13). Otherwise, the program proceeds to step D2. At step D2, the extra transition flag of Reel (N-1) in register XTRATR is cleared. Since Reel (N-1) is now stopped, any subsequent setting of its extra transition flag will indicate improper reel movement and cause an error signal to be generated.

As discussed above in conjunction with step A3 of FIG. 9A, if the signal to fire stopping solenoid 65 of a given reel is sent at the start of an odd field pattern (narrow slot/wide bar), and the extra transition flag of that reel is subsequently set, the microprocessor may conclude that a "true" positive transition has occurred, and that the sprocket 9 has skipped to the next rotational position beyond that stored in the reel's position counter. Accordingly, steps D3 to D6 are used to test whether the field number stored in RL(N-1)POS has an odd or even field pattern and thus determine whether the positive transition noted at step D1 was true or false.

Since field F30 is the only even numbered field having an odd field pattern, the program tests to see if the field number stored in register RL(N-1)POS is equal to 30 at step D3. More specifically, the number is transmitted to the accumulator of microprocessor 89, which is then tested to determine if its contents equal thirty. If so, the microprocessor converts this number to an odd number at step D4 by complementing the accumulator, and proceeds to step D5. If not, then the pattern of the field number in RL(N-1)POS is consistent with the even or odd state of its contents, and the program may proceed directly to step D5. At step D5, the microprocessor tests to see if the contents of RL(N-1)POS are even or odd, by dividing the contents of the accumulator by two (shifting all the bits to the right by one) and determining whether or not a "carry" bit was produced, indicating an odd number. If the field number was even, indicating that the stopping solenoid 65 of Reel (N-1) was fired on an even field pattern, the microprocessor must determine whether Reel (N-1) actually stopped at the field number in RL(N-1)POS, or whether it skipped to the next rotational position. The program thus proceeds to step D6 at which it is determined whether the sensor 25 of Reel (N-1) is presently indicating an odd or even field pattern. More specifically, microprocessor 89 accesses register LASTVAL which is loaded during each Reel Control Interrupt with the most recent value of the first direct input byte, comprising the states of reel phototransistors 75 and camshaft phototransistor 139. The bit in LASTVAL corresponding to the phototransistor 75 of Reel (N-1) may then be used to determine whether or not the contents of RL(N-1)POS correspond to the actual stopping position of Reel (N-1).

When the positioning of a reel relative to its corresponding sensor 25 and pawl arm 31 is properly adjusted, the reel will arrive at its intended stopping position approximately 12 milliseconds after the last positive transition of its track state, in accordance with the 12 millisecond anticipated stop response time of its rotation governing module 27. Since the reel spins at a rate of 31.25 milliseconds per field (one revolution per second), this stopping position will be reached when the sensing zone 87 of sensor 25 is located at a point 12/31.25, or just over $\frac{1}{3}$ of a field width (11°15′) past the start of the field which it crossed. Accordingly, if the reel is stopped on an even field pattern, sensing zone 87 will intersect a slot 69 of coding ring 19 (track state 1); if stopped on an odd field pattern, the sensing zone will intersect a bar 71 (track state 0).

Thus, if the microprocessor determines that RL(N-1)POS contains an even number other than 30 (at steps D3 and D5) and that the sensor 25 of Reel (N-1) is reading a track state of 1 (even field pattern) as determined by testing the corresponding bit of LASTVAL at step D6, the positive transition detected at step D1 is determined to be a false transition, and the contents of RL(N-1)POS are left unchanged. The program then returns to the step of the Reel Monitor routine from which it was called. However, if these determinations are not made, the program proceeds to step D7 at which the microprocessor increments the contents of RL(N-1)POS by one. At step D8 it is determined whether the incremented value of RL(N-1)POS equals 32, and it not, the microprocessor transmits the contents of that register to RL(N-1)POS/C of external RAM 99, at step D9, to preserve its contents in case of power interruption. If the new value equals 32, the microprocessor determines that the reel has stopped at F0, and clears RL(N-1)POS at step D10 before transmitting its contents to RL(N-1)POS/C at step D9. The program then returns to the step of the reel monitor routine (B7 or B13) from which it was called.

Interrupt Routine

FIGS. 10A to 10E present flow charts of the abovementioned interrupt routne, which is called by microprocessor 89 every 250 microseconds, upon issuance of a periodic signal from the microprocessor's internal interrupt clock. At step A1, the microprocessor stores various status conditions pertaining to the portion of the main program from which the Interrupt is being called, so that it will be able to continue processing the main program from the step where it left off, after the Interrupt routine is completed. At step A2, the microprocessor determines which type of interrupt will be performed during the present Interrupt routine, in accordance with the state of a serial I/O flag SIOF. SIOF is a single bit in a designated eight bit register of internal RAM, which is set during every other pass through the Interrupt routine. If it is set at step A2, the program performs a Serial I/O Interrupt, as discussed below with reference to FIG. 10E. If it is not set at step A2, the program performs a Reel Control Interrupt, which begins at step A3. Accordingly, the Serial I/O and Reel Control Interrupt are each performed once every 500 microseconds.

At step A3, after determining that SIOF is not set, the microprocessor sets it so that the next Interrupt routine will perform a Serial I/O Interrupt. At step A4, the latest sampling of reel and camshaft phototransistors 75 and 139 is transferred from register DINB1/C (direct input byte, in CMOS) in external CMOS RAM 99 and transmitted to general purpose register TEMP3 in microprocessor 89. DINB1/C is updated during every Serial I/O Interrupt to reflect the latest value of the inputs to first direct input circuit 113.

At step A5, the microprocessor determines which reels, if any, have made a positive or negative field state transition since the last Reel Control Interrupt. More specifically, the contents of register LASTVAL, which contains the value of register DINB1/C from the last Reel Control Interrupt, is transferred to the microprocessor's accumulator and exclusively OR'd with the contents of TEMP3 (new samples) so that only those bits of TEMP3 which have changed since the last Reel Control Interrupt will be set. The result is then stored in register TEMP4, and the program proceeds to step A6, in which the new optic samples of register TEMP3 are stored in LASTVAL, replacing the previous byte of optic samples.

At step A7, the microprocessor determines which of the sample transitions from step A5 were positive (low to high) transitions, by performing a logical AND operation between the contents of registers TEMP3 (new optic samples) and TEMP4 (sample transitions). The results of this operation are then stored in register TEMP3, replacing the new optic sample information which was stored in LASTVAL at step A6. At step A8, the microprocessor sets a single transition flag for each reel which has made a positive transition in register SGLTRF/C (single transition flag), to indicate that each reel has begun to move. SGLTRF/C is an eight bit CMOS register having a bit, or "single transition flag," corresponding to each reel. This register will be used in conjunction with the Reel (N) Slow routine, which will be discussed in conjunction with FIG. 10D.

At step A9, the program tests TEMP3 (positive transitions) to see if the bit corresponding to camshaft phototransistor 139 is set, indicating that the edge of finger 66 in camshaft positioning disc 68 has just passed sensor 64, and that the camshaft 50 has thus finished one revolution. If so, the program proceeds to step A10, at which the cocking motor bit of DOUTB1 is cleared, and the new value of DOUTB1 is latched into first direct output circuit 117, turning off cocking motor 52. If not, the program branches around step A10 and goes directly to step A11. At step A11 of the Reel Control Interrupt, the microprocessor tests register RLSTRT to see if any reels should be kicked. If not, the program branches to step A16, discussed below. It will be recalled that RLSTRT is an 8-bit register in internal RAM having a bit, or "reel start flag," corresponding to each of the three reels of the amusement machine.

These flags are tested at step A11 of the Interrupt routine, and if any are set, the microprocessor proceeds to step A12, in which the corresponding starting solenoids 53 are fired. For example, all three reel start flags are set at step A4 of the main program when handle 83 is pulled. In this case, the microprocessor would proceed to step A12 during the following Reel Control Interrupt and fire all three starting solenoids 53 by setting the three designated bits of register SOUTB1 used to control energization of the three corresponding starting solenoids 53. At the end of the next serial I/O cycle, START SPIN signals 1, 2 and 3 would be sent from driver circuit 131 to their three respective stopping solenoids 65, causing their associated pawl arms 31 to kick reels 2A, 2B and 2C.

It will be appreciated that all three reels need not be kicked at step A12. For example, if a tilt condition occurred while some reels were spinning but after others had stopped, it may be desirable not to rekick the stopped reels after the tilt condition has been cleared, especially if the reels that had stopped are displaying winning indicia 8. In this instance, the microprocessor may be programmed so that, when the tilt is cleared, (as by a serviceperson opening and closing door 28 for accessing the machine's interior) only those reel start flags corresponding to the reels which were spinning when the tilt condition occurred would be set, in accordance with the state of register DONE/C (set at step B6 of the Reel Monitor routine, FIG. 9B).

At step A13, the reel spin flags of RLSPNF, corresponding to the reels that were kicked in step A11, are set. These flags will stay set until the stop solenoids of their corresponding reels have been fired in a later Interrupt routine.

At step A14, register RLSTRT, which was set at step A4 in the main program (FIG. 9A) to enable reel kicking, is cleared. Register SONTMR is then loaded at step A15 with the binary equivalent of decimal number 14, which will be counted down in the Reel Control Interrupts at 500 microsecond intervals, to provide a solenoid on-time of 7 milliseconds. The program then proceeds to step A16.

At step A16, the microprocessor tests register SOUTB1 to see if any start solenoids 53 are presently energized. If SOUTB1 is clear (indicating no start solenoids are energized), the program branches to step A20. If not, the contents of SONTMR are decremented by one at step A17 and the program proceeds to step A18, at which the microprocessor tests to see if the new contents equal zero. If so, the microprocessor accesses SOUTB1 at step A19 and clears the bits which control the START SPIN signals of serial output driver 131, causing the start solenoids 53 to be deenergized after the following I/O cycle is finished. The program then proceeds to step A20. Alternatively, if the contents of SONTMR at step A18 were not equal to zero, the program would branch directly to step A20.

At step A20, the microprocessor tests DOUTB1 to see if any of the three bits corresponding to stopping solenoids 65 are set. If not, the microprocessor determines that no stopping solenoids are energized and branches to step A26. Otherwise, the program proceeds to steps A21 and A22, at which the microprocessor decrements solenoid timer SONTMR by 1 and branches to step A26 if the new value of SONTMR does not equal zero. If SONTMR equals zero, the microprocessor determines that the energized stopping solenoid should be turned off, and carries out steps A23 to A25.

At step A23, register RLSPNF is accessed and the reel spin flag of the reel whose stopping solenoid is energized (i.e., whose DOUB1 bit is set), is cleared to indicate that the reel has been stopped. At step A24, microprocessor 89 turns off the energized stop solenoid 65 by clearing the corresponding bit of DOUTB1 and transmitting the new contents of that register to first direct output circuit 117. It then transmits the new contents of DOUTB1 to DOUTB1/C at step A25, to preserve the state of the first direct output byte in case of a power interruption.

At step A26, the microprocessor accesses NUFLD and sets the new field flag of each reel that has made a positive transition. More specifically, the contents of TEMP3 (positive sample transitions) are logically OR'd with NUFLD, so that the new field flags which were previously set remain set, and those that were not are now set if their corresponding reel made a positive field state transition since the last Reel Control Interrupt. NUFLD may now be used during the main program in the Random Count subroutine, to determine when each reel makes a positive field state transition.

Figure 10A:
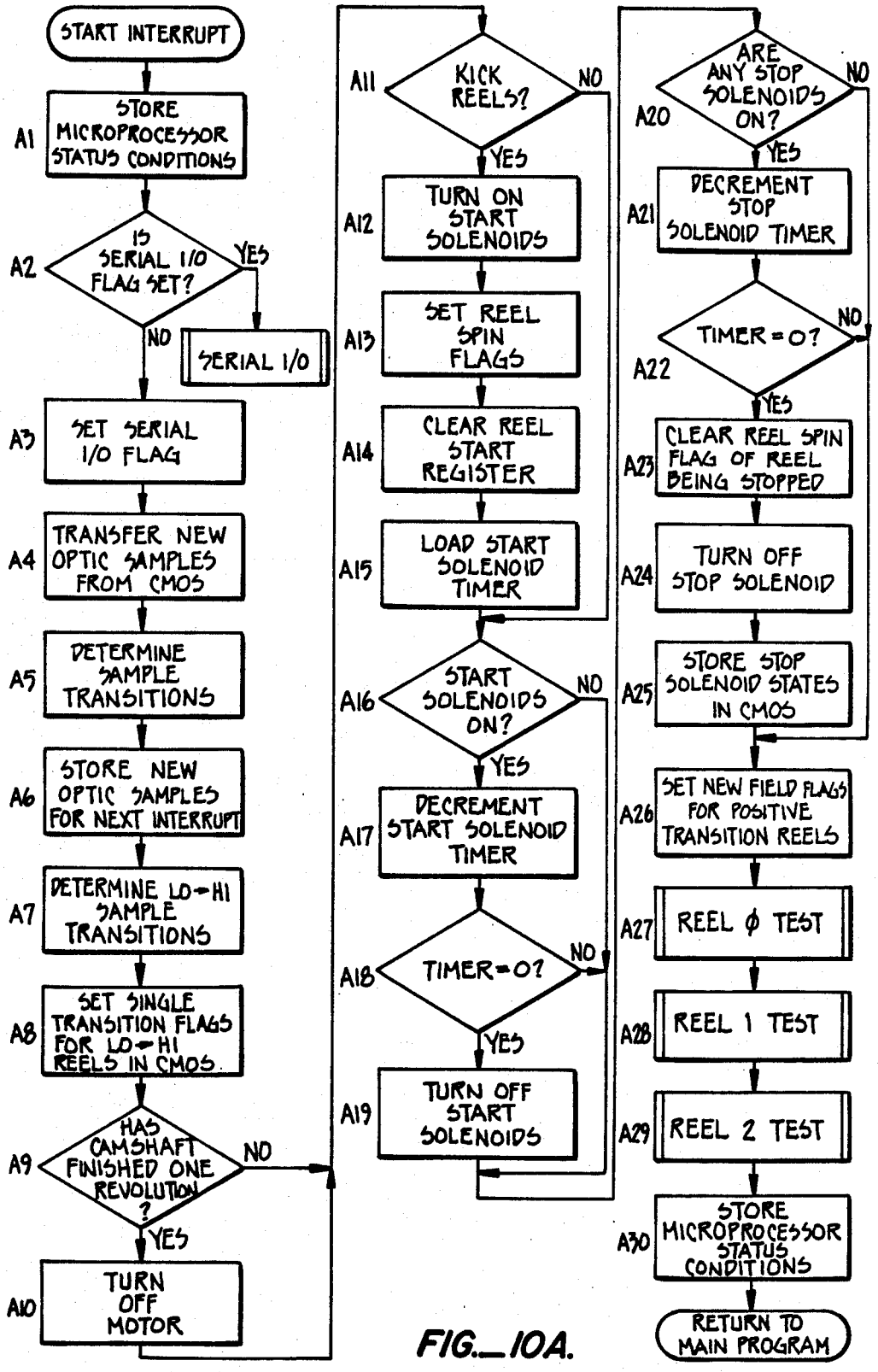

The program now proceeds to steps A27, A28, and A29, in which the Reel (0) Test, Reel (1) Test and Reel (2) Test routines are sequentially performed, as discussed in detail below. At step A30, the microprocessor status conditions that were stored at step A1 of the Interrupt routine are retrieved, so that the microprocessor can continue processing the main program from the point at which the Interrupt routine was called. The Interrupt routine of FIG. 10A is then completed, and the microprocessor returns to the main program.

Reel (N) Test Routine

FIG. 10B illustrates the processing steps of the Reel (0) Test, Reel (1) Test, and Reel (2) Test routines of steps A27–A29 in the Interrupt routine. Since the three Reel Test routines involve substantially the same processing steps, FIGS. 10B (and related FIGS. 10C and 10D) refer to a single, illustrative routine entitled "Reel (N) Test." Accordingly, at Interrupt routine step A27, the steps of FIG. 10B are performed with N=0 (first reel, 2A); at step A28 with N=1 (reel 2B); and at step A29 with N=2 (reel 2C). For ease of description, the following discussion of the Reel (N) Test routine will relate to Interrupt routine step A27, in which N=0.

At step B1, the microprocessor tests RLSPNF to see if the reel spin flag of Reel (0) is set, indicating that Reel (0) is, or should be, spinning. If the flag is not set, the program proceeds to the No Spin routine, discussed below. If it is set, the microprocessor tests to see if a positive or negative transition occurred in the most recent optic sample of Reel (0)'s phototransistor 75. More specifically, register TEMP4 (sample transitions—see step A5, FIG. 10A) is accessed, and the Reel (0) bit is tested; if clear, the program proceeds to step B3, in which an 8-bit register SAMCTR(0) (sample counter for Reel (O)) in internal RAM is incremented by one. SAMCTR(0) stores the number of optic samples of Reel (0)'s phototransistor 75 since the last field state transition of that reel was detected. Accordingly, it is incremented at step B3, and cleared each time a positive or negative optic sample transition is detected, as discussed below. At step B4, the microprocessor determines whether the contents of SAMCTR(0) equal 0, indicating that $2^8$ optic samples have been counted since the last transition. If so, the reel is turning too slowly, and the program branches to the Reel (N) Slow routine discussed below. If not, the Reel (0) Test routine is finished, and the program proceeds to Interrupt routine step A28.

Returning to step B2, if an optic sample transition is detected for Reel (0), the program proceeds to step B5, at which it is determined whether the transition was positive or negative. Register TEMP3 (positive transitions) is accessed and, if the bit corresponding to Reel (0) is clear (indicating the transition was negative), the microprocessor transmits the contents of SAMCTR(0) to 8-bit register SEG1R(0) (first segment of Reel (0)) of internal RAM at step B6. SEG1R(0) stores the number of Reel (0) optic samples counted while the first segment of each field 79 crossed the phototransistor 75 of that reel, for use in subsequent Reel (0) Test routines. SAMCTR(0) is then cleared at step B7 to complete the Reel (0) Test routine, and the program proceeds to Interrupt routine step A28.

If a positive optic sample transition is detected at step B5, the program proceeds to step B8 at which the microprocessor tests the SPINIT flag to see if spin initialization is in process. As discussed above with reference to FIG. 9A, step A5, spin initialization provides a brief delay before the microprocessor's rotation testing functions (direction, speed, and acceleration) are performed, thus allowing the reels to reach a constant rotational speed without generating an error signal. If SPINIT is set, the program branches to step B17; if not, the microprocessor proceeds to step B9, at which a test for reverse reel rotation is begun.

At step B9, the microprocessor determines whether the last field past sensor 25 of Reel (0) contained an odd or even field pattern, by comparing the contents of SAMCTR(0) to those of SEG1R(0). SAMCTR(0) now contains the number of samples counted during the last field's second segment or "second segment count," and SEG1R(0) contains the number of samples counted during that field's first segment, or "first segment count." If the first segment count is less than or equal to the second, the microprocessor determines that the last field pattern was odd (wide slot/narrow bar), based on an assumption of correct rotational direction, and proceeds to step B10. The second segment count is now divided by two in the accumulator to create a modified second segment count. At step B11, the modified second segment count is compared to the first segment count, to determine whether the reel is spinning in the correct rotational direction. Since the width of the second segment of an odd field pattern is more than three times that of the first segment, the modified second segment count should still be greater than the first segment count, in which case the microprocessor will determine that Reel (0) is still spinning in the correct rotational direction, and proceed to step B17. However, if the reel is spinning in the wrong direction (counterclockwise with respect to FIG. 5), the widths of the two segments corresponding to registers SAMCTR(0) and SEG1R(0) will be equal, so their respective segment counts will be sufficiently close to fail the test of step B11 if the reel speed and acceleration are otherwise within acceptable limits, as determined in the following steps of the Reel (0) Test routine. In this case, the program branches to step B12, in which a Reel (0) Reverse Error code is loaded into the microprocessor's accumulator, and then proceeds to step B13, at which the microprocessor tests to see if a tilt (from another source of error) is already in progress. If not, the program branches to a Process Tilt routine at step B14, in which control circuit 29 sends a REEL (0) REVERSE error signal to a device, such as a memory register or LED, which may be checked by a service person to determine the cause of the tilt condition. If a tilt is already in progress at step B13, the Reel (0) Test routine ends, and the program proceeds to Interrupt routine step A28, at which the Reel (1) Test routine is performed.

If the second segment count had been less than the first segment count at step B9, the microprocessor would determine that the last field pattern was even (wide slot/narrow bar), based on an assumption of correct rotational direction, and proceed to steps B15 and B16. Steps B15 and B16 are the counterparts of B10 and B11 for even field patterns, in which the microprocessor tests for proper rotational direction. The first segment count is divided by two in the accumulator and then compared to the second segment count. If the modified first segment count is greater, the program proceeds to step B17; if not, it branches to steps B12 to B14, at which the Reel (0) Reverse Error code is loaded and processed as discussed above.

At step B17, the first and second segment counts in SAMCTR(0) and SEG1R(0) are added in the accumulator to determine the total number of samples that were counted while the last field passed sensor 25 ("new field count"). At step B18, the new field count is divided by two, by rotating the contents of the accumulator to the right by one, and is then exchanged for the contents of eight bit register FLDCNT(0) (Field Count for Reel (0)) at step B19. The modified new field count is now stored in FLDCNT(0), and the "modified old field count" which preceded it is now in the accumulator.

At step B20, the microprocessor again determines whether spin initialization is in process, by testing SPINIT; if so, the program branches to step B32; if not, it proceeds to step B21, at which the test for proper reel speed is begun. The modified old field count stored in the accumulator is compared to a "minimum speed" constant equal to decimal number 45. If the modified old field count is greater than 45, this indicates that the corresponding field took over 90 samples (or 45 milliseconds) to pass sensor 25, and the reel is therefore spinning too slowly. If not, the program proceeds to step B22, at which the microprocessor determines whether the modified old field count is greater than a "maximum speed" constant of 25. If so, the reel is spinning of a rotational speed which is within acceptable limits, and the program proceeds to step B24. If not, this indicates the corresponding field took less than 50 samples, or 25 milliseconds, to pass sensor 25; accordingly, the reel is spinning too fast. If step B21 or B22 indicates that the reel is spinning too slow or too fast, the program branches to step B23, at which a Reel (0) Speed Error code is loaded in the accumulator. It then proceeds to step B13, discussed above, to determine whether a tilt is in progress. If so, the Reel (0) Test routine is finished. If not, the program proceeds to step B14 to process a tilt routine in which a Reel (0) Speed Error code is used to indicate that the tilt was caused by a speed error on Reel (0).

At step B24, the microprocessor begins a test for improper reel acceleration by subtracting the modified new field count in register FLDCNT(0) from the modified old field count in the accumulator. At step B25, it determines whether the difference is positive (new field count less than or equal to old field count) or negative.

If the difference is positive, indicating that the reel is accelerating or maintaining constant speed, the program proceeds to step B26 at which a "maximum acceleration" constant equal to decimal number 8 is subtracted from the modified field count difference, creating an "acceleration difference" which is tested at step B27. If the acceleration difference is negative, this indicates that the difference between the last two field counts is less than 16, and the reel's acceleration is therefore within acceptable limits. The program then proceeds to step B32. On the other hand, if the acceleration difference is greater than or equal to zero at step B27, this indicates a difference of 16 or more samples between the last two field counts, which is beyond the acceptable acceleration limit. The program then proceeds to step B28, at which a Reel (0) Acceleration Error code is loaded in the accumulator. The microprocessor then proceeds to step B13, and, if a tilt is in progress, ends the Reel (0) Test routine. If not, a tilt is processed at step B14, in which the microprocessor indicates that the tilt was caused by excessive acceleration of Reel (0).

If a negative modified field count difference had been determined at step B25, this would indicate that Reel (0) was decelerating and the program would then branch to steps B29 to B31 to determine whether the deceleration was within acceptable limits. At step B29, the absolute value of the modified field count difference is obtained by complementing the accumulator's content. A "maximum deceleration" constant equal to decimal number 8 is then subtracted from this number to provide a "deceleration difference." At step B30, the microprocessor determines whether the deceleration difference is negative and if so, proceeds to step B32. If the deceleration difference is positive or equal to zero, this indicates a difference of at least 16 samples between the old and new field counts, which is beyond the acceptable deceleration limits. Accordingly, the program proceeds to step B31 at which a Reel (0) Deceleration Error code is loaded in the accumulator. The microprocessor then proceeds to step B13 to determine if a tilt is already in progress. If so, the Reel (0) Test routine is complete; if not, the microprocessor proceeds to step B14 and processes a tilt in which it is indicated that the cause of the tilt was a deceleration error on Reel (0).

If the microprocessor arrives at step B32, Reel (0) is deemed to be properly rotating, and the microprocessor proceeds to update its position counter RL(0)POS. At step B32, the microprocessor determines whether the modified new field count stored in register FLDCNT(0) is less than the second segment count stored in SAMCTR(0). Since the modified new field count is equal to one-half the total new field count, a negative determination at step B32 indicates that the new field pattern is even, and the program proceeds to step B33 at which the number 3 is loaded in an eight bit internal RAM register SYNCTR(0) (Synch Counter for Reel (0)). The microprocessor then increments position counter RL(0)POS by one at step B34, and proceeds to step B38.

If the modified new field count had been less than the second segment count at step B32, the microprocessor would conclude that the new field pattern was odd and would then decrement the synch counter SYNCTR(0) by one at step B35. At step B36 it is determined if the contents of SYNCTR(0) are equal to zero. If not, it is concluded that new field was not F31 and the program proceeds to step B34 to increment position counter RL(0)POS. If SYNCTR0 equals zero at step B36, this indicates that three successive odd field patterns have passed, and the new field (i.e., the last field past Reel (0)'s sensor 25) was therefore F31. Accordingly, the program proceeds to step B37, in which position counter RL(0)POS is cleared, and then to step B38. Sample counter SAMCTR(0) is then cleared so that the next Reel Control Interrupt will begin counting the number of samples in field F0, and the Reel (0) Test routine ends. The program now proceeds to step A28, in which the Reel (1) Test routine is performed with respect to reel 2B.

Figure 10C:
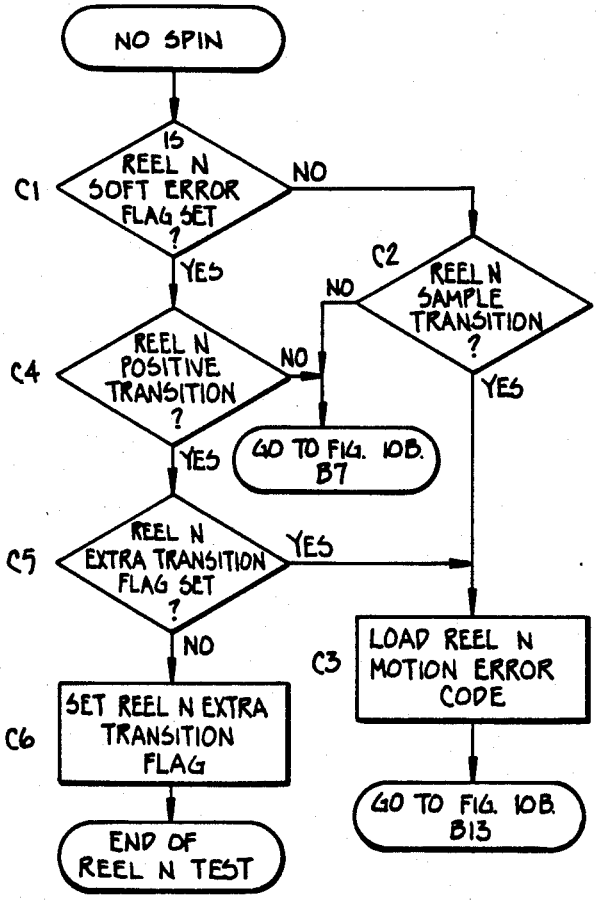

FIG. 10C illustrates the No Spin routine to which the Reel (N) Test routine branches if the reel spin flag of Reel (N) is not set at step B1 of FIG. 10B. To simplify the following discussion, FIG. 10C will be described with reference to Reel (0), consistent with the above description of the Reel (0) Test routine.

The No Spin routine of FIG. 10C is performed after a determination, at step B1 of the Reel (0) Test routine, that the reel spin flag of Reel (0) is not set, indicating that the energization of Reel (0)'s stopping solenoid 65 has ended; thus, the reel is not, or should not be moving. At step C1, the microprocessor determines whether the soft error flag for Reel (0) is set in register SOFTEN. If not, Reel (0) should not be moving at all, and any simple transitions on that reel's phototransistor 75 would indicate improper reel motion. Accordingly, the program tests register TEMP4 (positive or negative sample transitions) at step C2. If the bit corresponding to Reel (0) is set, indicating that a sample transition has occurred, the microprocessor loads a Reel (0) Motion Error code in the accumulator at step C3, and proceeds to step B13 of the Reel (N) Test routine. It then determines if a tilt is already in progress, and if not, processes a tilt operation in which it is indicated that improper motion occurred on Reel (0) after it stopped. Alternatively, if the Reel (0) bit of TEMP4 had been clear at step C2, this would indicate that no improper motion had been detected on Reel (0), and the program would then proceed to step B7, to clear SAMCTR(0) and end the Reel (0) Test routine.

If the Reel (0) soft error flag had been set at step C1, this would indicate that soft error processing was still in effect after deenergizing the stopping solenoid 65 of Reel (0), so the real should either be stopped or about to stop. As disccussed above, it is possible to sense a "false" positive sample transition during this period, even though the reel is about to settle in the intended stopping position. The microprocessor therefore tests TEMP3 (positive transitions) at step C4 to determine if a positive sample transition has been detected by Reel (0)'s sensor 25. If not, the program proceeds to step B7 of FIG. 10B, at which SAMCTR(0) is cleared before the Reel (0) Test routine ends. However, if the Reel (0) bit of TEMP3 is set, the microprocessor tests XTRATR at step C5 to see if the extra transition flag of Reel (0) is set, indicating that this is the second positive transition detected since the stopping solenoid 65 of Reel (0) was fired. If so, the program branches to step C3, loads the Reel (0) Motion Error code in the accumulator, and proceeds to step B13 of the Reel (0) Test routine discussed above. If the Reel (0) extra transition flag is clear at step C5, indicating this is the first positive transition detected since the stopping solenoid 65 of Reel (0) was fired, the microprocessor sets the Reel (0) extra transition flag of register XTRATR at step C6 to complete the Reel (0) Test routine. The program then proceeds to Interrupt routine step A28, to start the Reel (1) Test routine.

Figure 10E:
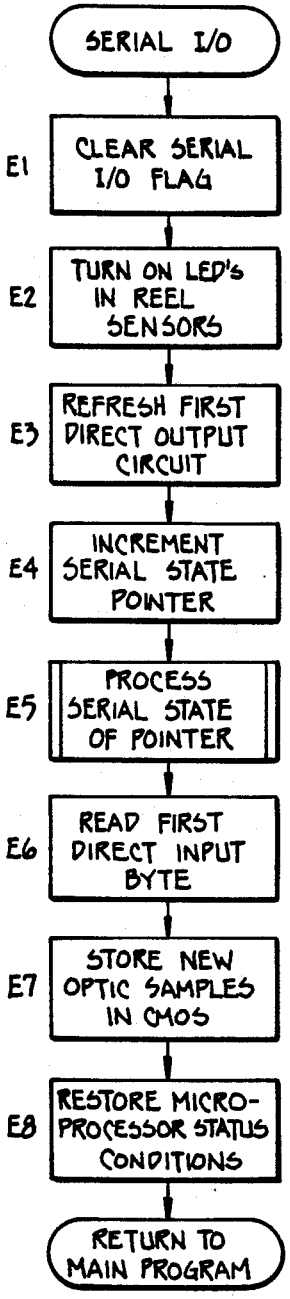
Figure 10D:
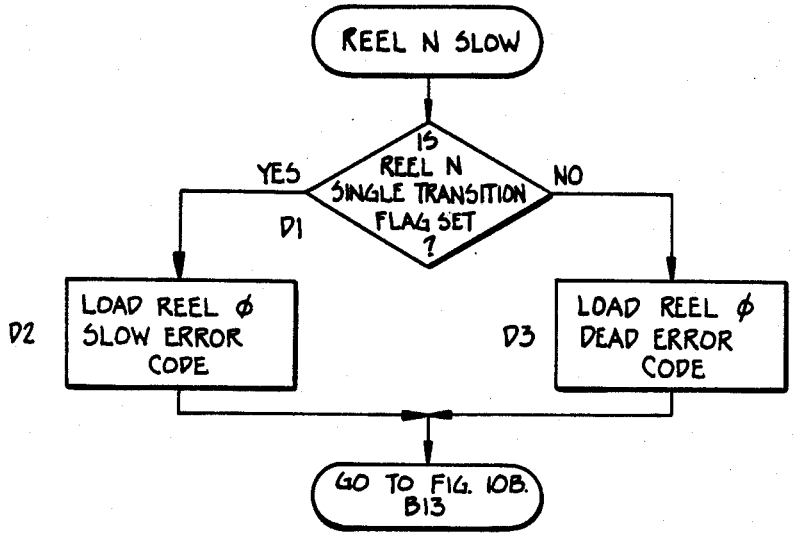

FIG. 10D is a flow chart of the Reel (N) Slow routine, to which the Reel (N) Test routine branches at step B4 (FIG. 10B) if the microprocessor has counted $2^8$ samples of Reel (0) with no transitions. In this case, Reel (0) has either failed to spin after its starting solenoid 53 was fired (as when start spring 37 is broken), or began spinning and was abruptly slowed down or stopped.

At step D1, the microprocessor tests the single transition flag corresponding to Reel (0) in SGLTRF/C, to determine whether that reel ever moved after it was kicked. If it did, a Reel (0) Slow Error code is loaded in the accumulator at step D2 to indicate that the reel began moving and then abruptly slowed down. If Reel (0) never moved, its single transition flag would be clear at step D1 and the microprocessor would load a Reel (0) Dead Error code in the accumulator at step D3. After the appropriate error code is loaded in the accumulator at step D2 or D3, the microprocessor proceeds to step B13 of the Reel (0) Test routine at which it determines whether a tilt is already in progress. If not, the program branches to the Process Tilt routine at step B14, in which the error signal corresponding to the appropriate error code is sent to a corresponding device for indicating the cause of the tilt condition. If a tilt is already in progress at step B13, the Reel (0) Test routine ends and the program proceeds to Interrupt routine step A28, at which the Reel (1) Test routine is performed.

FIG. 10E is a flow chart of the processing steps performed in the Serial I/O Interrupt which is performed if the serial I/O flag SIOF is set at step A2 of the Interrupt routine. At step E1, the serial I/O flag SIOF is cleared, so that a Serial I/O Interrupt will not be performed during the next Interrupt routine. By clearing this flag at step E1, and setting it at step A3 of the interrupt routine, the microprocessor is programmed to perform a Serial I/O Interrupt during every other Interrupt routine, or once every 500 microseconds.

At step E2, the microprocessor turns on LEDs 73 in reel sensors 25 by writing a byte of data to second direct output latch 153 (as discussed above in conjunction with FIG. 8) in which the bits corresponding to the three reels are set. In order to allow sufficient time for the LEDs 73 to reach optimum brightness, it is preferable to wait approximately 90 microseconds after the LEDs have been turned on before sampling their corresponding phototransistors 75. The Serial I/O Interrupt is therefore preferably designed to process 90 microseconds or more of program instructions before the microprocessor reads the first direct input byte.

At step E3, the first direct output byte is refreshed by reading the contents of register DOUTB1 into the first direct output latch 149. If the bit of DOUTB1 corresponding to cocking motor 52 was previously set at step A8 of the main program, this Serial I/O Interrupt will supply power to the cocking motor at step E3, while the respective states of stopping solenoids 65, which form the remainder of the first direct output byte, are refreshed.

At step E4, the microprocessor accesses an eight bit, general purpose register TEMP5 in internal RAM, and increments the value of a serial state "pointer" which it contains. Since six Serial I/O Interrupts are performed in each serial I/O cycle, the microprocessor must carry out a different "serial state" during each such interrupt so as to receive and transmit the appropriate bytes of serial input and output data and perform necessary processing operations with this data before storing it. Accordingly, register TEMP5 is used to indicate which one of these six serial states is to be performed during any given Serial I/O Interrupt.

At step E5, the program shifts to the serial state which is pointed to by register TEMP5 and performs the processing operations required by that serial state. During the first serial state, step E5 is initiated by latching serial input and output shift registers 121 and 127 so as to sample the twenty-four serial inputs and provide new data to the forty-eight serial outputs. During each serial state, the microprocessor writes a byte of serial output from the appropriate one of registers SOUTB1 to SOUTB6 into serial output buffer 125, and resets the serial clock by instructing Read/Write Logic 107 to send signal ESIB. In addition, during each of the second, third and fourth serial states, a byte of serial input data is read from serial input buffer 123 into the appropriate one of registers SINB1 to SINB3 after signal ESIB is sent, as discussed above in conjunction with FIG. 8. During the last serial state, the "pointer" in TEMP5 is cleared so that the Serial I/O cycle will be repeated.

At step E6, the microprocessor reads the byte of data from first direct input buffer 143 into its accumulator, to obtain a new sampling of the states of reel phototransistors 75 and camshaft phototransistor 139. It will be understood that the LED 165 opposite camshaft phototransistor 139 need not be pulsed in the same manner as reel LEDs 73, since the sampling of positioning disc 68 is not as critical as that of coding ring 19. LED 165 may therefore be connected to a constant source of power, for simplicity.

At step E7, the new optic samples which were read into the accumulator at step E6 are stored in register DINB1/C of external RAM 99, to be used during the following Reel Control Interrupt. The program then proceeds to step E8, at which the microprocessor status conditions that were stored at step A1 of the Interrupt routine are retrieved so that the microprocessor can continue carrying out the main program from the point at which the Interrupt routine was called. The Interrupt routine of FIG. 10A is then completed and the microprocessor returns to the main program.

Diagnostic Test Routine

FIGS. 11A to 11D illustrate the sequence of steps performed by microprocessor 89 in executing a Diagnostic Test Routine which forms a portion of the main program. The Diagnostic Test Routine executes the series of tests discussed above under the heading "General Operation—B. Diagnostic Tests". These tests are performed, in response to a signal from a service technician via diagnostic test switch 30, to help determine whether the mechanical response of rotation governing modules 27 and reels 2 is within acceptable limits.

Figure 11A:
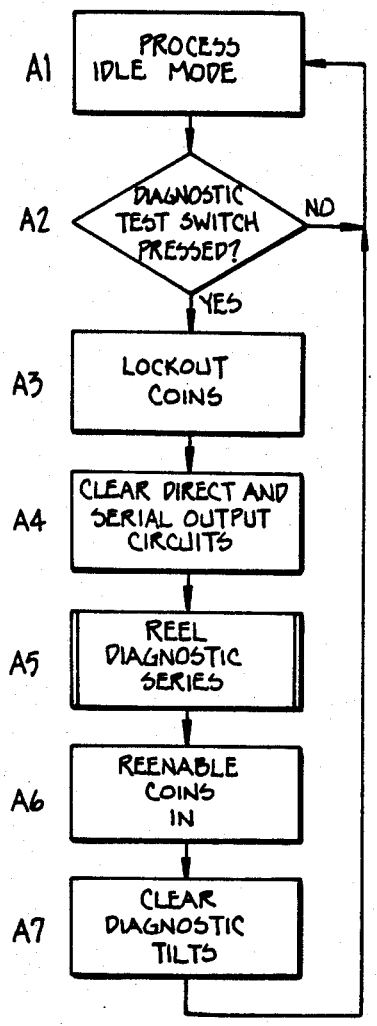

As seen in FIG. 11A, step A1, the diagnostic test routine is entered from the "idle mode" of the slot machine, which corresponds to one of the non-reel spin states discussed above at step A1 of FIG. 9. The idle mode is initiated when the last round of game play is completed, which immediately follows the coin payout of a winning round or a determination that a winning combination is not present. The idle mode ends when a player inserts a coin in slot 81 to start a new round of game play. During the idle mode, the main program cycles through a series of instructions which perform the processing steps of FIG. 11, with interrupts occur-ring every 250 microseconds to alternately perform the Reel Control and Serial I/O Interrupt routines discussed above with reference to FIG. 10.

At FIG. 11, step A1, the microprocessor determines whether diagnostic test switch 30 is being pressed, by testing the appropriate bit of serial input registers SINB-1-SINB3 which holds the DS (Diagnostic Start) flag. When diagnostic test switch 30 is pressed, a corresponding bit in shift register 121 is set upon receipt of signal DIAGNOSTIC START, and the following I/O cycle transfers the content of that bit to flag DS. At step A2 in FIG. 11, the microprocessor tests DS and, if it is set, proceeds with the Diagnostic Test Routine which begins at step A3. If flag DS is not set, the program returns to step A1 and continues to process the other routines of the idle mode.

At step A3, the microprocessor prepares to perform the above described series of diagnostic tests by setting a flag CL (coin lockout) in an internal RAM register, which is used to control a mechanism associated with coin slot 81 which blocks insertion of coins during the Diagnostic Test Routine. The program then proceeds to step A1, in which the serial and direct output circuits 111, 117 and 119 are cleared in preparation for the diagnostic test series. More specifically, microprocessor 89 is instructed to load all zeros into the parallel output ports PO of 48 bit shift register 127, first direct output latch 149 and second direct output latch 153. The program then proceeds to step A5 at which the Reel Diagnostic Series subroutine is called, as discussed below with reference to FIG. 11B. When the Reel Diagnostic Series subroutine is finished, the program proceeds to step A6 at which flag CL is cleared, so that coins may again be inserted into coin slot 81 to initiate game play. At step A7, any tilt flags that may have been set during the Diagnostic Test Routine are cleared to enable tilt processing during nondiagnostic machine operations. The program then returns to step A1 and continues to process the other routines in the idle mode.

Figure 11B:
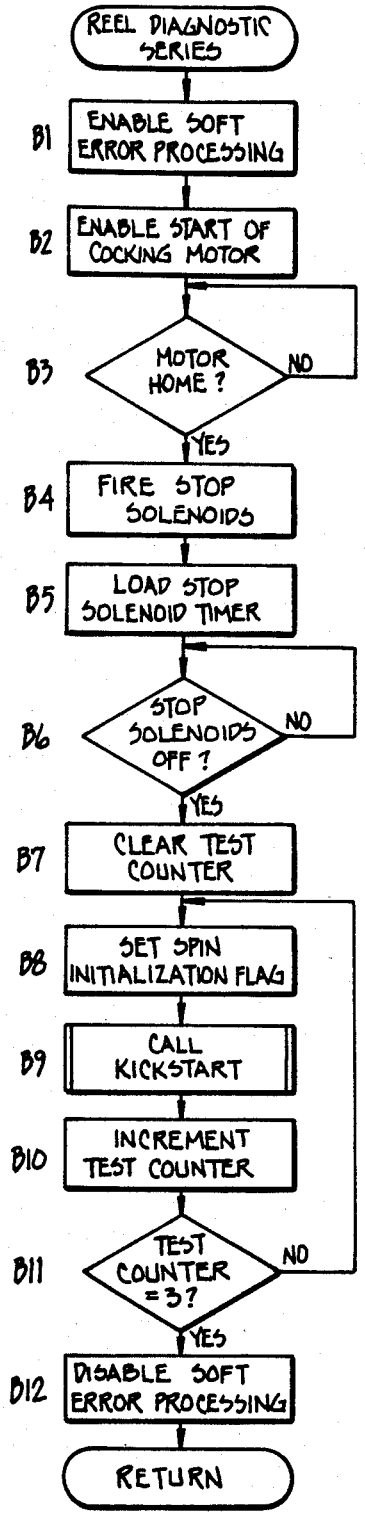

FIG. 11B illustrates the processing steps of the Reel Diagnostic Series subroutine which was called at step A5 of FIG. 11. At step B1, soft error processing is enabled by setting the soft error flags in register SOFTEN corresponding to each of the three reels, in preparation for a reel spinning operation.

At step B2, the cocking motor bit in register DOUTB1 is set, enabling the cocking motor 52 to be turned on during the following I/O Interrupt. This is done to ensure that the cocking motor is in its "home" position before the first diagnostic test is started. At the following step, B3, the microprocessor tests the camshaft sensor bit in register LASTVAL to determine whether or not the cocking motor is in its home position (with finger 66 blocking camshaft sensor 64; see FIGS. 4A and 4B). If so, the cocking motor will be turned off during the following Reel Control Interrupt (see FIG. 10, step A9), and the program proceeds to step B4. If not, this indicates that the cocking motor was in the middle of a cycle when diagnostic test switch 30 was pressed; accordingly, the program loops at step B3 until the cocking motor finishes its cycle, before proceeding to step B4.

At step B4, all stopping solenoids 65 are fired to ensure that all reels have stopped spinning before the diagnostic test series is initiated. More specifically, the microprocessor accesses register DOUTB1 and sets the bits corresponding to each of the stopping solenoids. The contents of DOUTB1 are then transmitted to first direct output circuit 117, causing the STOP SPIN signal to be sent to each of the stopping solenoids 65.

At step B5, register SONTMR (solenoid on timer) is loaded with the binary equivalent of decimal number 14. This number will be counted down during the proceeding Reel Control Interrupts until the stopping solenoids have energized for seven milliseconds (see FIG. 10, steps A20 to A25). The program then proceeds to step B6 where it loops until all stopping solenoids have been turned off. More specifically, the stopping solenoid bits of register DOUTB1 are tested to see if they were cleared during the preceding Reel Control Interrupt (FIG. 10, step A24). If not, this indicates that the stopping solenoids are still being energized; so the program loops at step B6 until this is finished.

The program then proceeds to step B7 at which register TEMP6, the "test counter", is cleared. TEMP6 is an eight bit general purpose register in internal RAM which is used, at this point in the program, to store the diagnostic test number which is presently in progress. That is, when TEMP6 equals zero, the first diagnostic test is in progress; one indicates the second test and two indicates the third test.

At step B8, the spin initialization flag SPINIT is set in preparation for kicking the reels, as discussed above with reference to FIG. 9, step A5. The program then proceeds to step B9 and calls subroutine Kick Start, which is discussed in detail below with reference to FIG. 11C. During Kick Start, microprocessor 89 spins all the reels and performs the diagnostic test whose number is contained in register TEMP6.

When the program returns from subroutine Kick Start, it proceeds to step B10 and increments the test count contained in register TEMP6. The program then proceeds to step B11 and tests to see if the contents of TEMP6 are equal to three, indicating that all three diagnostic tests have been performed. If not, the program returns to step B8 and proceeds with the next diagnostic test. Alternatively, if TEMP6 is equal to three, the program proceeds to step B12 at which soft error processing is disabled by clearing the three bits in register SOFTEN corresponding to the three reels. The Reel Diagnostic Series subroutine is now finished and the program returns to FIG. 11, step A5 from which it was called.

FIG. 11C is a flow chart of the steps performed by the Kick Start subroutine which was called at step B9 at FIG. 11. As discussed previously, each of the diagnostic tests spins all of the reels and stops them at known stopping positions, which are stored at designated locations in external RAM 99. At step C1, the microprocessor transfers the intended reel stopping positions from external RAM 99 into registers TEMP1 (first reel), TEMP7 (second reel) and TEMP8 (third reel). The program then proceeds to step C2, in which reel kicking is enabled by setting the three reel start flags in register RLSTRT. These flags will be used during the following Reel Control Interrupt to fire the three start solenoids 53. The program then proceeds to step C3, at which the spin initialization flag SPINIT is set in anticipation of a reel kicking operation, as discussed above with reference to FIG. 9, step A5, and the program proceeds to step C4.

At step C4, the microprocessor clears the single transition flags for each reel in register SGLTRF/C, which will be used during subsequent Interrupt routines to determine whether a given reel began spinning after it was kicked.

At step C5, the main program loops for 50 milliseconds while the reels are kicked. The 50 millisecond delay allows pawl arms 31 to finish traveling from their respective REEL SET to REEL SPIN positions before starting cocking motor 52.

At step C6, the cocking motor bit of register DOUTB1 is set, enabling the cocking motor to be turned on during the following I/O Interrupt. The program then loops for 300 milliseconds at step C7 to allow sufficient time for cocking motor 52 to move camshaft positioning disk 68 off the "home" position provided by finger 66. It then tests register LASTVAL at step C8 to determine whether the motor 52 has moved. It will be recalled that one of the bits in LASTVAL contains the most recent sample of phototransistor 129 in camshaft sensor 64. If this bit is high, the microprocessor determines that camshaft positioning disk 68 has moved off the home position, so motor 52 is functioning properly. If it is low, this indicates finger 66 is still blocking the path of light from LED 165 to phototransistor 139, and that cocking motor 52 is either stopped or moving too slowly, thus requiring servicing.

If camshaft positioning disk 68 has not moved off home at step C8, the cocking motor bit of DOUTB1 is cleared at step C9, enabling motor 52 to be turned off during the next Reel Control Interrupt; the program then proceeds to step C10. Alternatively, if it were determined that disk 68 had moved off home at step C8, the program would proceed directly to step C10.

At step C10, the SPINIT flag is cleared so that all rotation testing functions may now be performed during subsequent Reel Control Interrupts. The main program then proceeds to step C11 in which the cocking motor bit of register DOUTB1 is tested to see whether the motor was turned off at step C9. If so, the program loads the Motor Tilt Error code into the microprocessor's accumulator at step C12, and proceeds to the Process Tilt routine at step C13. The Process Tilt routine stops diagnostic testing and sends a message to display 84 indicating that the cocking motor is not working properly.

If the microprocessor determines that the cocking motor is on at step C11, the program proceeds to step C14, at which it loops until all reels have passed their home positions. More specifically, the microprocessor tests the new field flags in register NUFLD, and loops until each reel has registered at least one positive field state transition. This ensures that the reel position counter RL(N)POS of each reel will thereafter contain a number greater than zero until the reels have passed their home positions. The program then tests each reel's reel position counter RL(N)POS and loops until each counter has been cleared, indicating that each reel has now passed its home position and ensuring that the reel position counters accurately reflect the rotational positions of their respective reels.

At step C15, the cocking motor bit of DOUTB1 is tested and, if the motor is on, registers TEMP2 and TEMP9 are used as a Motor Timer, to assure that the cycling time of the cocking motor is not abnormally slow. At step C16, the motor timer is loaded with a number which corresponds to a motor "on-time" of approximately one second. The motor timer is decremented at step C17 after each Serial I/O Interrupt (i.e., every 500 microseconds), and tested at step C18 to see if it equals zero, indicating that the motor has been on for the maximum allowable time period. If so, the program branches to steps C12 and C13, and processes a Motor Tilt Error code. If not, the microprocessor returns to step C15 and tests to see whether the cocking motor is still on.

If the cocking motor is off at C15, this indicates that it has finished its cycle within the maximum allowable time limit, and the program proceeds to step C19.

At step C19, the microprocessor loads the address of the first reel's position counter RL(0)POS into register TEMP9, to be used during the Wait Stop subroutine of step C10. This subroutine determines when each of the reels has reached its intended stopping position, and fires stopping solenoids 65 in accordance with the variations of the three diagnostic tests, as discussed more fully below with reference to FIG. 11D.

At step C21, the microprocessor tests the parity of Reel 0 to determine whether that reel stopped at its intended stopping position. As explained above in the discussion of FIG. 9, step D6, when a reel stops on an even field pattern of coding ring 19, the reel's sensor 25 will straddle a slot 69 of coding ring 19, and thus display a track state of 1; if stopped on an odd field pattern, it will output a track state of zero. Since the fields of coding ring 19 alternate between odd and even field patterns, except for the three sequential odd field patterns of the home position, the stopping positions selected for the diagnostic tests are chosen from the non-home fields (F0 to F28), to allow the microprocessor to easily determine whether any given reel skipped to the next field beyond its intended stopping position.

Thus, at step C21 the microprocessor tests the appropriate bit of LASTVAL to determine whether the field state being detected by the sensor 25 of the first reel (Reel 0) matches the field state which would be present at the intended stopping position. If the actual and anticipated field states match, the microprocessor determines that parity exists for Reel 0, indicating that it has stopped at its intended stopping position. If parity does not exist for this reel, the program proceeds to step C22 at which the Reel 0 Motion Error code is loaded in the accumulator. It then processes a tilt routine at step C23, in which further diagnostic testing is suspended and a message is sent to display 84 indicating that improper movement has occurred on the first reel.

If the first reel's parity is established at step C21, the program proceeds to load the address of RL(1)POS into TEMP9 at step C24. At step C25 the contents of TEMP7, which holds the intended reel stopping position of Reel 1, are transferred to TEMP1, for use in the Wait Stop subroutine of step C26. At step C27, the program determines whether parity exists for Reel 1, and if not, proceeds to steps C28 and C29 which process a tilt based on the Reel 1 Motion Error code, in a similar manner to steps C22 and C23 above.

If the second reel's parity is established at step C27, the program transfers the address of RL(2)POS into TEMP9 at step C30. At step C31, the contents of TEMP8, which holds the intended stopping position of Reel 2, are transferred to TEMP1 for use in the Wait Stop subroutine of step C32. When the program returns from this subroutine, it determines whether parity exists for the third reel at step C33. If not, a tilt operation is processed based on the Reel 2 Motion Error code, as illustrated at steps C34 and C35. If parity exists for the third reel at step C33, the program returns to step B9 of FIG. 11, from which the Kick Start subroutine was called, and continues the processing of the Reel Diagnostic Series subroutine.

Figure 11D:
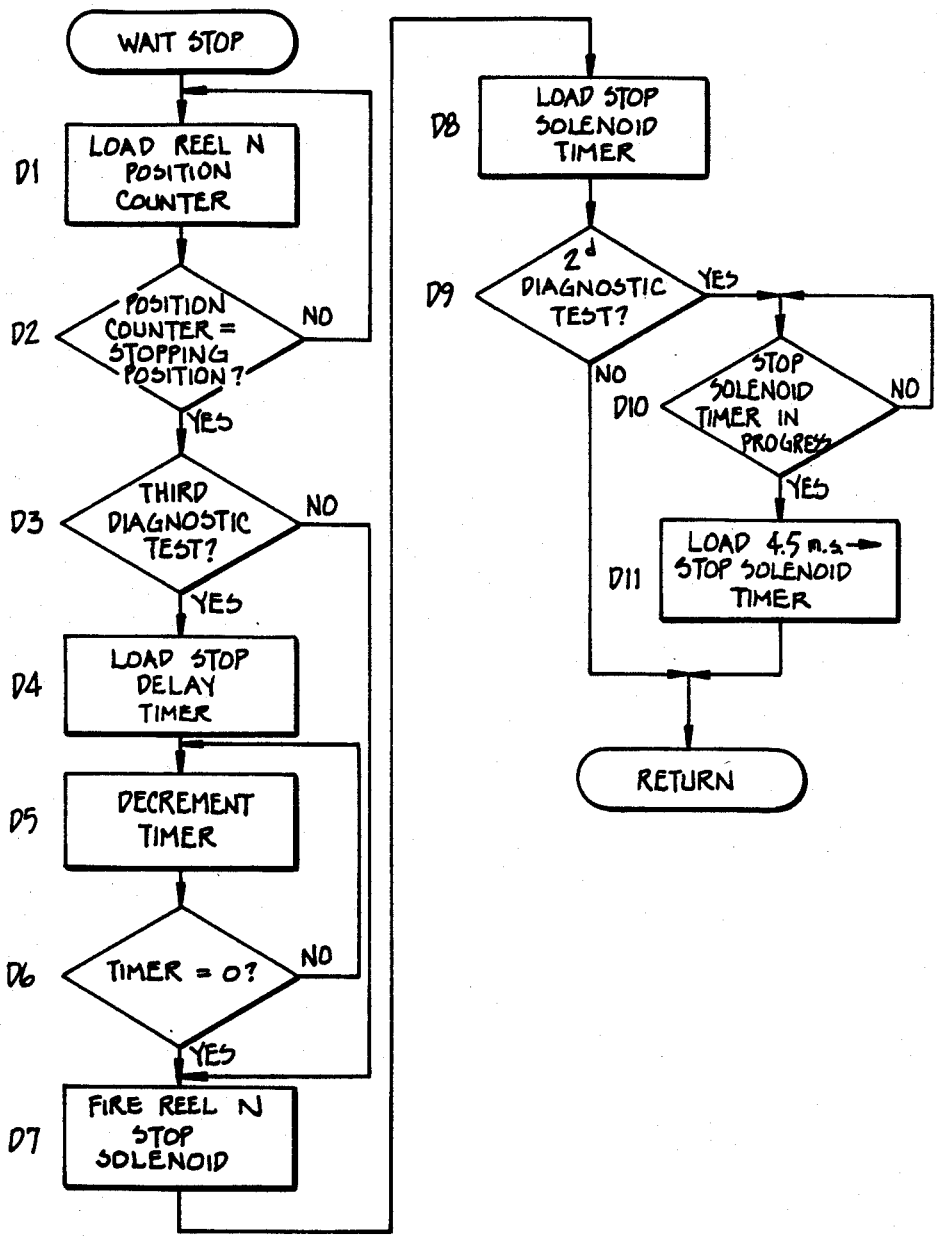

FIG. 11D illustrates the processing steps of the Wait Stop subroutine, which is called from the Kick Start subroutine at steps C20, C26 and C32. Since the Wait Stop subroutine is performed once for each reel of the slot machine during each of the diagnostic tests, FIG. 11D illustrates the steps of this subroutine with respect to any given Reel "N" for which this subroutine may be called.

At step D1, the contents of the position counter for Reel N (RL(N)POS) is loaded into the accumulator from the address location specified by register TEMP9. At step D2, the program compares the present rotational position of Reel N (in the accumulator) to the intended stopping position stored in TEMP1. If they are not equal, indicating that Reel N has not reached its intended stopping position, the program branches back and repeats steps D1 and D2 until the intended stopping position has been reached. The program then proceeds to step D3.

At step D3, the microprocessor tests the contents of register TEMP6 to determine which diagnostic test is in progress. If TEMP6 equals two, indicating the third diagnostic test, the program proceeds to step D4, at which the stop delay timer is loaded. More specifically, register TEMP2 is loaded with the binary equivalent of number 16. The program then proceeds to step D5 at which TEMP2 is decremented following each I/O Interrupt (i.e., every 500 microseconds), corresponding to a total stop delay timer period of six milliseconds. At step D6, the program tests the contents of stop delay timer TEMP2; if non-zero, the program loops through steps D5 and D6 until TEMP2 equals zero, completing the desired six millisecond delay. The program then proceeds to step D7, at which the stopping solenoid 65 of Reel N is fired by setting the appropriate register of DOUTB1 and transmitting the contents of this register to first direct output circuit 117.

Alternatively, if the third diagnostic test had not been in progress at step D3, the program would branch directly to step D7 and fire the stopping solenoid of Reel N without the six millisecond delay of steps D4 to D6.

At step D8, register SONTMR is loaded with the number 14 to provided a seven millisecond stop solenoid on-time. At step D9, the microprocessor tests register TEMP6 and, if its consists are equal to one (second diagnostic test), it proceeds to load a shortened, 4.5 millisecond stop solenoid energization period in accordance with the operation of the second diagnostic test. At step D10, it tests the contents of SONTMR and loops until they are equal to 13, indicating that one pass has been completed through the Reel Control Interrupt routine since Reel N's stopping solenoid was fired (see FIG. 10, steps A20 and A21). The program then proceeds to step D11 at which SONTMR is loaded with the number 9. This register is decremented every 500 microseconds during the Reel Control Interrupt routine (see FIG. 10, step A21), providing a shortened stop solenoid on time of 4.5 milliseconds. The program then returns to the portion of the Kick Start subroutine from which it was called.

Alternatively, if the second diagnostic test had not been in progress at step D9, the program would return directly to the step of the Kick Start subroutine from which it was called, retaining the normal stop solenoid energization period of seven milliseconds.

From the above description, it will be understood that the first test of the Diagnostic Test Routine performs a reel spinning and stopping operation in which the start and stopping solenoids of each reel are energized and de-energized in the same manner as in a normal round of game play. The second test of the Diagnostic Test Routine repeats the first test, but shortens the on-time of each stopping solenoid 65 from 7 milliseconds to 4.5 milliseconds to see whether these solenoids are capable of stopping their respective reels at the intended stopping positions with an energy input significantly less than that provided during normal game play. The third test of the Diagnostic Test Routine repeats the first test, but delays the firing of each stopping solenoid by 6 milliseconds to see whether the stop response time of its associated reel governing mechanism is still within the range of response times necessary to stop its reel at the intended stopping position.

If desired, an alternate embodiment may also provide for a test of the start solenoids 53 during the second test, by providing for direct, rather than serial output of the START SPIN signals to the start solenoids, and adding appropriate instructions between steps C2 and C3 of the Kick Start subroutine of FIG. 11 to replace the contents of register SONTMR with a shortened start solenoid on-time, as is done with the stopping solenoid on-time at FIG. 11, steps D3 to D6.

From the above description, it will be apparent that the subject matter of this invention is capable of taking various useful forms, and it is intended, therefore, that this disclosure be taken in an exemplary sense and the scope of protection afforded be determined by the appended claims.

What is claimed is:

1. An apparatus for testing an amusement device having a transducer means for performing a prescribed mechanical movement from a first position to a second position in response to an electrical signal, comprising:

diagnostic test initiating means for signaling the start of a test of said transducer means;

control means for providing a first amount of electrical energy to said transducer means in response to a predetermined condition during normal operation of said machine, the control means including testing means responsive to said diagnostic test initiating means for providing a lesser amount of electrical energy than said first amount to said transducer means; and verification means for detecting whether said transducer means has performed said mechanical movement from said first position to said second position in response to said lesser amount of electrical energy.

2. Apparatus for controlling the engagement of first and second members configured for movement relative to each other and for contacting each other at one of a plurality of selected contact locations in an amusement device comprising:

means for driving one of said members to contact the other member at one of the plurality of selected contact locations in response to an electrical signal;

diagnostic test initiating means for commanding a test of said driving means;

means for controlling the contact of said members at an intended one contact location, the controlling means including means for issuing said electrical signal to said driving means at a predetermined normal issuance time; and means responsive to said diagnostic test initiating means for timing the issuance of said electrical signal to said driving means offset from said normal issuance time.

3. Apparatus for testing an amusement device having first and second members configured for movement relative to each other and for contacting each other at a selected contact location and a transducer operative to cause the members to contact each other at the selected contact location in response to a predetermined electrical signal during normal operation of the machine, comprising:

means for modifying said predetermined electrical signal, and means responsive to said modifying means for sensing whether said members have contacted each other at said selected contact location.

4. Apparatus as set forth in claim 3, wherein the electrical signal modified by said modifying means delivers a lesser amount of electrical energy to said transducer than said predetermined electrical signal.

5. Apparatus according to claim 4, wherein said first and second members comprise a pin and a sprocket, the sprocket being mounted for rotation relative to the pin and having a plurality of notches shaped to receive said pin, each defining a single contact location, and said transducer comprises a solenoid;

said machine further including a driving mechanism for causing said pin and sprocket to contact each other at one of the contact locations in response to said predetermined electrical signal, said driving mechanism including said solenoid and a mechanical linkage coupling said solenoid to said pin; and wherein said electrical signal modified by said modifying means has a shorter duration than said predetermined electrical signal.

6. Apparatus according to claim 5, further comprising:

diagnostic test initiating means for signaling the start of a test of said driving mechanism;

means responsive to said diagnostic test initiating means for designating first and second successive tests in a series of diagnostic tests;

said modifying means comprising means responsive to designation of said first test by said designating means for issuing said shorter duration electrical signal;

said sensing means comprising a sensor cooperatively mounted with said sprocket to detect the rotational position of said sprocket;

said machine further comprising control means responsive to said sensor for issuing said predetermined electrical signal during normal operation of said machine at a time when said sprocket is in a predetermined rotational position; and means responsive to designation of said second test by said designating means for issuing a second modified electrical signal to said solenoid at a time delayed from said time when said sprocket is in said predetermined rotational position.

7. Apparatus as set forth in claim 3, wherein the electrical signal modified by said modifying means is issued to said transducer at a time offset from the time of issuing said predetermined electrical signal during normal operation of the machine.

8. Apparatus according to claim 7, wherein said first and second members comprise a pin and a sprocket, the sprocket being mounted for rotation relative to the pin and having a plurality of notches shaped to receive said pin, each defining a single contact location, and said transducer comprises a solenoid;

said machine further including a driving mechanism for causing said pin and sprocket to contact each other at one of the contact locations in response to said predetermined electrical signal, said driving mechanism including said solenoid and a mechanical linkage coupling said solenoid to said pin;

said sensing means comprising a sensor cooperatively mounted with said sprocket to detect the rotational position of said sprocket;

said machine further comprising control means responsive to said sensor for issuing said predetermined electrical signal during normal operation of said machine at a time when said sprocket is in a predetermined rotational position; and wherein the electrical signal modified by said modifying means is issued to said solenoid at a time delayed from said time when said sprocket is in said predetermined rotational position.

9. In an amusement device having first and second members configured for movement relative to each other and for contacting each other at a selected contact location and a transducer operative to cause the members to contact each other at the selected contact location in response to a predetermined electrical signal during normal operation of the machine, the improvement comprising:

means for modifying said predetermined electrical signal, and means responsive to said modifying means for sensing whether said members have contacted each other at said selected contact location.

10. The improvement as set forth in claim 9, wherein said modified electrical signal delivers a first amount of electrical energy to said transducer, and said predetermined electrical signal delivers a second amount of electrical energy to said transducer, said second energy amount being greater than said first energy amount.

11. Apparatus according to claim 10, wherein said first and second members comprise a pin and a sprocket, the sprocket being mounted for rotation relative to the pin and having a plurality of notches shaped to receive said pin, each defining a single contact location, and said transducer comprises a solenoid;

said machine further including a driving mechanism for causing said pin and sprocket to contact each other at one of the contact locations in response to said predetermined electrical signal, said driving mechanism including said solenoid and a mechanical linkage coupling said solenoid to said pin; and wherein said electrical signal modified by said modifying means has a shorter duration than said predetermined electrical signal.

12. Apparatus according to claim 11, further comprising:

diagnostic test initiating means for signaling the start of a test of said driving mechanism;

means responsive to said diagnostic test initiating means for designating first and second successive tests in a series of diagnostic tests;

said modifying means comprising means responsive to designation of said first test by said designating means for issuing said shorter duration electrical signal;

said sensing means comprising a sensor cooperatively mounted with said sprocket to detect the rotational position of said sprocket;

said machine further comprising control means responsive to said sensor for issuing said predetermined electrical signal during normal operation of said machine at a time when said sprocket is in a predetermined rotational position; and means responsive to designation of said second test by said designating means for issuing a second modified electrical signal to said solenoid at a time delayed from said time when said sprocket is in said predetermined rotational position.

13. The improvement as set forth in claim 9, wherein said predetermined electrical signal is issued to said transducer at a first time when said two members are in a predetermined position with respect to each other, and said modifying means comprises means for issuing said modified electrical signal at a second time which is offset from said first time.

14. Apparatus according to claim 13, wherein said first and second members comprise a pin and a sprocket, the sprocket being mounted for rotation relative to the pin and having a plurality of notches shaped to receive said pin, each defining a single contact location, and said transducer comprises a solenoid;

said machine further including a driving mechanism for causing said pin and sprocket to contact each other at one of the contact locations in response to said predetermined electrical signal, said driving mechanism including said solenoid and a mechanical linkage coupling said solenoid to said pin;

said sensing means comprising a sensor cooperatively mounted with said sprocket to detect the rotational position of said sprocket;

said machine further comprising control means responsive to said sensor for issuing said predetermined electrical signal during normal operation of said machine at a time when said sprocket is in a predetermined rotational position; and wherein the electrical signal modified by said modifying means is issued to said solenoid at a time delayed from said time when said sprocket is in said predetermined rotational position.

* * * * *